US007510266B2

(12) United States Patent
Takagi

(10) Patent No.: US 7,510,266 B2
(45) Date of Patent: Mar. 31, 2009

(54) IMAGE FORMING APPARATUS

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 360 days.

(21) Appl. No.: 11/364,266

(22) Filed: Mar. 1, 2006

(65) Prior Publication Data

US 2006/0203032 A1 Sep. 14, 2006

(30) Foreign Application Priority Data

Mar. 1, 2005 (JP) ..... 2005-055875
Mar. 4, 2005 (JP) ..... 2005-061676
Mar. 4, 2005 (JP) ..... 2005-061678

(51) Int. Cl.
*B41J 2/165* (2006.01)

(52) U.S. Cl. ..... 347/33; 347/22; 347/29; 347/30

(58) Field of Classification Search ..... 347/33, 347/22, 29, 30
See application file for complete search history.

(56) References Cited

U.S. PATENT DOCUMENTS 6,074,037 A 6/2000 Nakahara et al.
6,406,123 B1 * 6/2002 Usui et al. ..... 347/29
2004/0183840 A1 * 9/2004 Ushigome ..... 347/2

FOREIGN PATENT DOCUMENTS

JP 60260341 12/1985
JP 60260341 A * 12/1985
JP 03272860 12/1991
JP 9240012 9/1997
JP 200062201 2/2000
JP 200180086 3/2001
JP 200389210 3/2003

OTHER PUBLICATIONS

European Patent Office, European Search Report for Related EP Application No. 06251079.7 dated Aug. 1, 2006.

* cited by examiner

*Primary Examiner*—Manish S Shah
*Assistant Examiner*—Laura E Martin
(74) *Attorney, Agent, or Firm*—Baker Botts L.L.P.

(57) ABSTRACT

An image forming apparatus includes a conveyance unit, a recording head and a cap. The conveyance unit conveys a recording medium. The recording head includes a nozzle formation surface formed with a plurality of nozzles for ejecting ink toward the recording medium being conveyed by the conveyance unit. The cap is able to abut against the nozzle formation surface of the recording head to form a closed space in which the nozzle formation surface is sealed off. The cap includes a base portion, a lip portion, an opening and a flexible film. The base portion faces the nozzle formation surface. The lip portion is upright from the base portion toward the nozzle formation surface to be able to abut against the nozzle formation surface. The opening passes through the base portion. The flexible film covers the opening.

13 Claims, 15 Drawing Sheets

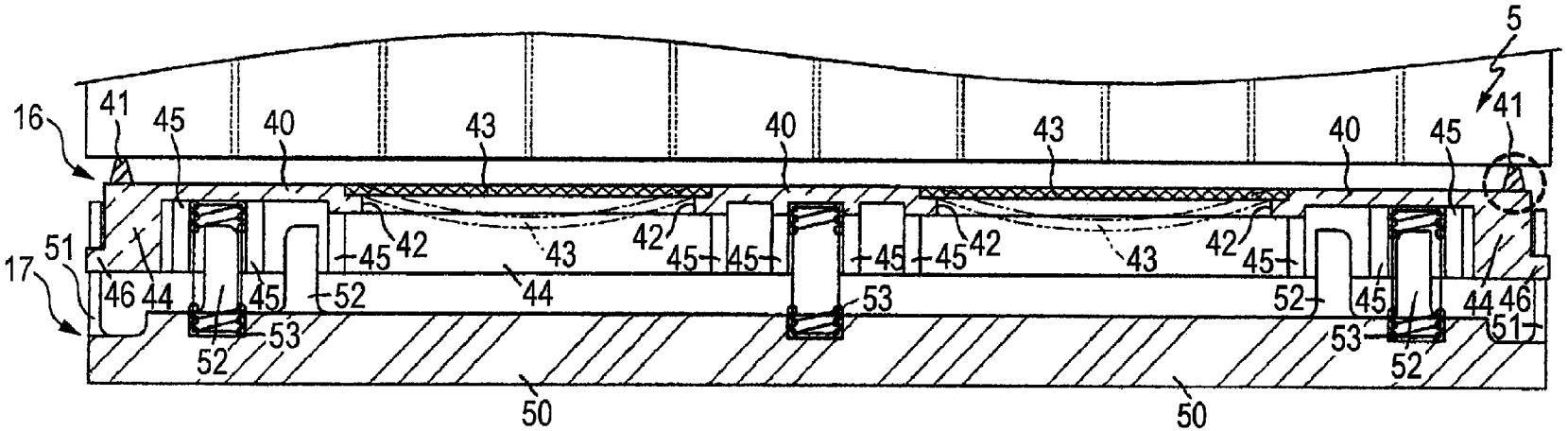
FIG. 9A
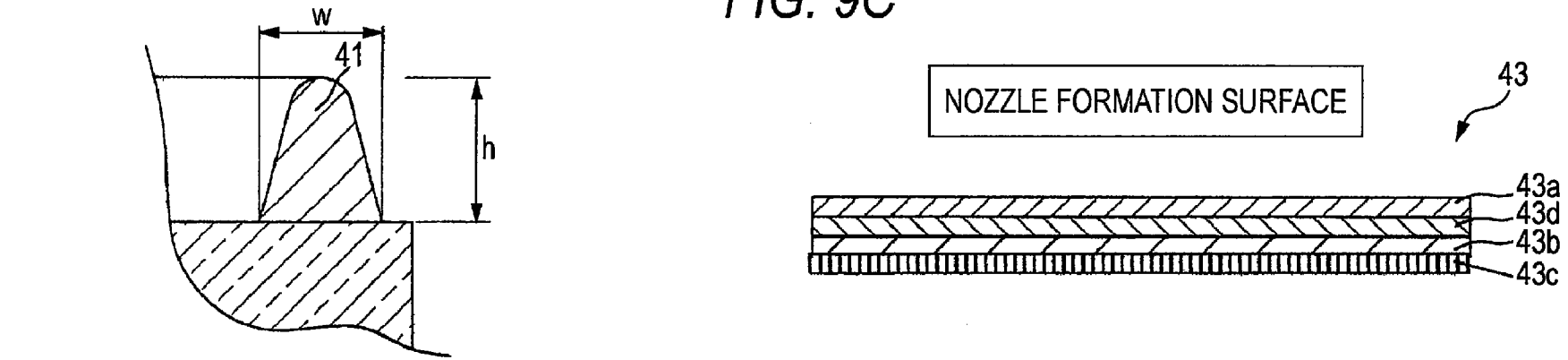
FIG. 9B
FIG. 9C

IMAGE FORMING APPARATUS

CROSS-REFERENCE TO RELATED APPLICATIONS

This application is based upon and claims the benefit of priority from Japanese Patent Application No. 2005-55875 filed on Mar. 1, 2005, Japanese Patent Application No. 2005-61676 filed on Mar. 4, 2005 and Japanese Patent Application No. 2005-61678 filed on Mar. 4, 2005; the entire contents of which are incorporated herein by reference.

BACKGROUND OF THE INVENTION

1. Field of the Invention

The invention relates to an image forming apparatus, which is capable of preventing meniscuses from being destroyed due to change in an internal pressure at a time when a nozzle forming surface is capped and/or temperature change during the capping, the destruction of the meniscus leading in deterioration of ink ejection performance.

2. Description of the Related Art

An image forming apparatus has been known, which ejects ink onto a recording medium being conveyed from nozzles provided on a recording head to form an image on the recording medium. In order to prevent ink ejected from nozzles from drying when unused, this type of image forming apparatuses include a cap that is abut against a nozzle formation surface of the recording head to form a closed space in which the nozzle formation surface is sealed off.

JP Hei. 9-240012 (for example, FIG. 6) discloses an ink ejection apparatus including a cap body corresponding to the above-mentioned cap, as an image forming apparatus including the cap. The cap body has a concave portion defined by a bottom surface facing the nozzle formation surface and a wall, which is upward from the periphery of the bottom surface toward the nozzle formation surface. Further, an incision, which is in a closed state at normal times and is opened only when a force is applied to the bottom surface, is formed in the bottom surface.

According to the cap body configured as mentioned above, change in internal pressure generated at the time of capping is absorbed by opening the incision. Therefore, it is possible to prevent the meniscus from being destroyed due to the change in the internal pressure.

SUMMARY OF THE INVENTION

However, as disclosed in JP Hei. 9-240012, in the method of absorbing the change in the internal pressure at the time of capping by providing the openable incision in the bottom surface of the cap body, even when the incision is in the closed state at normal times, a slight gap communicating inside and outside of the concave portion with each other is present in a joint of the incision. Therefore, even if capping is performed, since the inside of the cap communicates with the outside through the gap, it is difficult to satisfactorily prevent the ink from drying.

This invention provides an image forming apparatus and a cap, which are capable of preventing meniscuses from being destroyed due to change in an internal pressure at a time when a nozzle forming surface is capped and/or temperature change during the capping, the destruction of the meniscus leading in deterioration of ink ejection performance. Also, the image forming apparatus and the cap can reduce a amount of the dried ink during the capping state.

According to one aspect of the invention, an image forming apparatus includes a conveyance unit, a recording head and a cap. The conveyance unit conveys a recording medium. The recording head includes a nozzle formation surface formed with a plurality of nozzles for ejecting ink toward the recording medium being conveyed by the conveyance unit. The cap is able to abut against the nozzle formation surface of the recording head to form a closed space in which the nozzle formation surface is sealed off. The cap includes a base portion, a lip portion, an opening and a flexible film. The base portion faces the nozzle formation surface. The lip portion is upright from the base portion toward the nozzle formation surface to be able to abut against the nozzle formation surface. The opening passes through the base portion. The flexible film covers the opening.

According to the above configuration, when an environmental temperature rises after capping or during capping, the film covering the opening is depressed and swelled to the opposite side to the recording head. Thus, the film absorbs the change in pressure in the closed space. Further, when the environmental temperature falls during capping, the film is swelled toward the recording head so as to absorb the change in pressure. Accordingly, meniscuses is prevented from being destroyed due to the change in pressured caused by a change in environmental temperature after capping or during capping. Therefore, stable ink ejection performance can be maintained.

According to another aspect of the invention, a cap is used for an image forming apparatus including a conveyance unit and a recording head. The conveyance unit conveys a recording medium. The recording head includes a nozzle formation surface formed with a plurality of nozzles for ejecting ink toward the recording medium being conveyed by the conveyance unit. The cap is able to abut against the nozzle formation surface so as to form a closed space in which the nozzle formation surface is sealed off. The cap includes a base portion, a lip portion, an opening and a flexible film. The base portion faces the nozzle formation surface. The lip portion is upright from the base portion toward the nozzle formation surface so as to be able to abut against the nozzle formation surface. The opening passes through the base portion. The flexible film covers the opening.

According to the above configuration, when the environmental temperature rises after capping or during capping, the film covering the opening is depressed and swelled to the opposite side to the recording head. Therefore, the film can absorb the change in pressure in the closed space. Further, when the environmental temperature falls during capping, the film is swelled toward the recording head so as to absorb the change in pressure. Accordingly, meniscuses are prevented from being destroyed due to the change in pressured caused by a change in environmental temperature after capping or during capping. Therefore, stable ink ejection performance can be maintained.

BRIEF DESCRIPTION OF THE DRAWINGS

FIG. 9A is an enlarged cross-sectional view showing a state where lip portions of a cap main body abut against a nozzle formation surface, FIG. 9B is an enlarged cross-sectional view of the lip portion, and FIG. 9C is an enlarged cross-sectional view of a film.

DETAILED DESCRIPTION OF EMBODIMENTS OF THE INVENTION

Figure 1:
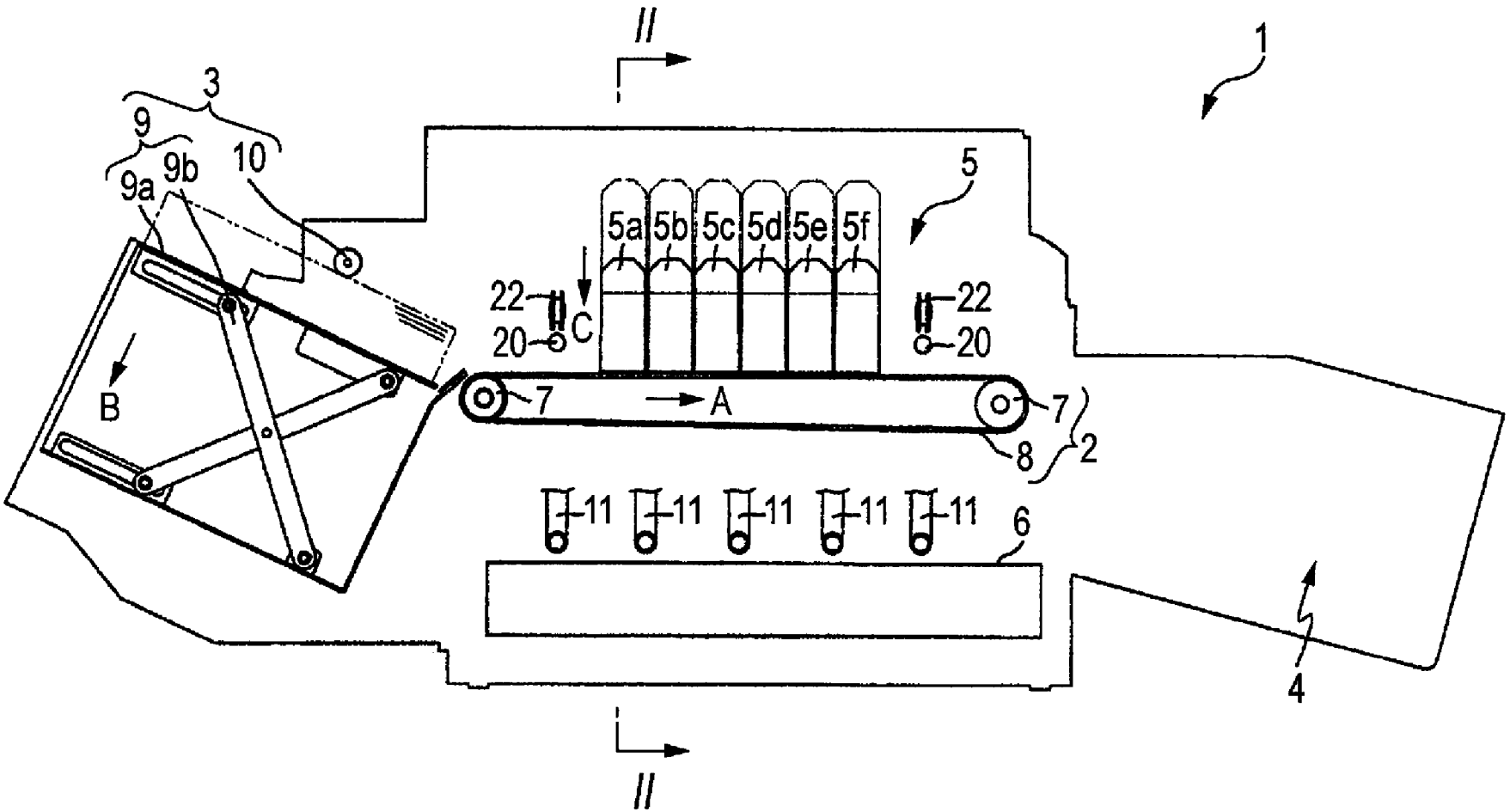
FIG. 1 is a diagram showing the internal configuration of an image forming apparatus.
Figure 2:
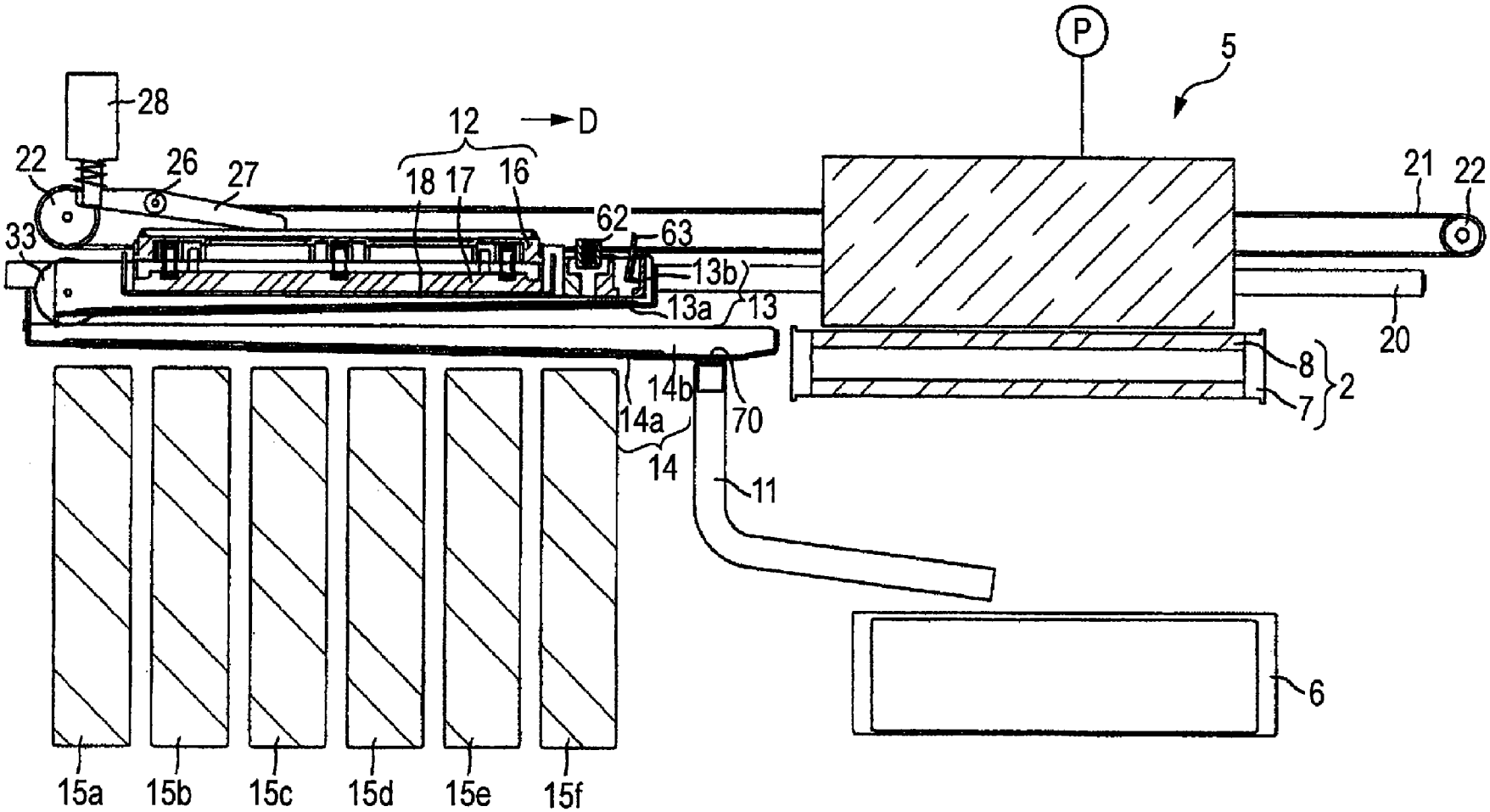
FIG. 2 is a cross-sectional view showing the internal configuration of the image forming apparatus 1 taken along a line II-II of FIG. 1.

Hereinafter, embodiments of the invention will be described with reference to the accompanying drawings. FIG. 1 is a diagram showing the internal configuration of an image forming apparatus 1 of this embodiment. The image forming apparatus 1 primarily has a conveyance unit 2, a paper feed unit 3, a paper discharging unit 4, a recording head unit 5 and a waste ink tank 6. The conveyance unit 2 conveys a recording medium in a direction of an arrow A. The paper feed unit 3 is disposed on an upstream side (the left side of FIG. 1) of the conveyance unit 2 and conveys the recording medium. The paper discharging unit 4 is disposed on a downstream side (the right side of FIG. 1) of the conveyance unit 2 with the conveyance unit 2 being interposed between the paper feed unit 3 and the paper discharging unit 4. The paper discharging unit 4 stores the recording medium conveyed by the conveyance unit 2. The recording head unit 5 is disposed above the conveyance unit 2 and ejects ink toward the recording medium being conveyed by the conveyance unit 2. The recording head unit 5 is connected to a pump P as shown in FIG. 2, and when the purge operation is performed, the pump P applies positive pressure to respective nozzles of the recording head unit 5 to eject a predetermined amount of ink together with dust and/or dried ink adhering to the nozzles. The waste ink tank 6 is disposed below the conveyance unit 2 with the conveyance unit being interposed between the waste ink tank 6 and the recording head unit 5. The waste ink tank 6 stores ink ejected during a purge operation through a tube 11. It is noted that the pump P is only shown in FIG. 2 and omitted in the other drawings. Moreover, other parts of the image forming apparatus 1 will be described below.

The conveyance unit 2 has a pair of conveyance rollers 7, which is disposed at a predetermined interval in the direction of the arrow A, and a conveyance belt 8, which has a predetermined width and is stretched between the pair of conveyance rollers 7. In the conveyance unit 2, if a conveyance motor 89 (see FIG. 12) is driven, one conveyance roller 7 of the pair of conveyance rollers 7 rotates rightward through a transfer mechanism (not shown) by driving force of the motor 89. The conveyance belt 8 and the other conveyance roller 7 rotate rightward accordingly. Then, the recording medium, which is conveyed from the paper feed unit 3 onto the conveyance belt 8, is conveyed in the direction of the arrow A, and finally is discharged to the paper discharging unit 4.

The paper feed unit 3 has a lift device 9 and a pickup roller 10, which is disposed above the lift device 9. The lift device 9 has a support plate 9*a* and arms 9*b*, which are connected to the support plate 9*a* so as to reciprocate the support plate 9*a* in a direction of an arrow B and a direction opposite to the arrow B.

The stacked recording media (see a two-dot-chain line in FIG. 1) are placed on the support plate 9*a*. If a lift motor 90 (see FIG. 12) is driven, the arms 9*b* move the support plate 9*a* such that the recording medium abut against the pickup roller 10. Then, the recording media are sequentially conveyed from an uppermost recording medium by the pickup roller 10, which rotates according to driving force of a pickup motor 91 (see FIG. 12).

The recording head unit 5 has six recording heads 5*a* to 5*f*, which correspond to ink of six colors of cyan, magenta, yellow, black, light cyan, and light magenta. The recording heads 5*a* to 5*f* are arranged in parallel along the conveyance direction A of the recording medium.

Further, nozzles for ejecting ink are formed in a surface (hereinafter, referred to as "nozzle formation surface") of each of the recording heads 5*a* to 5*f*, which faces the conveyance belt 8. The nozzles are arranged in a zigzag manner in a direction (from the front side of the paper of FIG. 2 toward its back side) perpendicular to the conveyance direction A of the recording medium. When ink is ejected from the nozzles, an image is formed on the recording medium being conveyed by the conveyance unit 2.

In addition, the recording heads 5*a* to 5*f* are connected integrally by a connection member (not shown). The connection member is movable vertically in a direction of an arrow C and a direction opposite to the arrow C. Accordingly, the recording heads 5*a* to 5*f* are movable vertically and integrally in the direction of the arrow C and the direction opposite to the arrow C.

That is, when an image is formed on the recording medium, the recording head unit 5 is located at a position close to the conveyance belt 8 (see a solid line of FIG. 1). Further, at the time of purge processing or capping, the recording head unit 5 is integrally moved from that position along the direction distant from the conveyance belt 8 (the direction opposite to the arrow C) (see the two-dot-chain line of FIG. 1). In addition, at the time of forming the image on the recording medium again, the recording head unit 5 is integrally moved in the direction of the arrow C so as to be located at the position close to the conveyance belt 8.

Also, the recording head unit 5 is of a so-called line head type. Specifically, the nozzle formation surface of each of the recording heads 5*a* to 5*f* has a larger length in a main scanning direction perpendicular to the conveyance direction A of the recording medium, than the maximum width of a recording medium, which the image forming apparatus 1 handles. Therefore, when forming an image on a recording medium being conveyed by the conveyance unit 2, the recording head unit 5 (the recording heads 5*a* to 5*f*) ejects ink onto the recording medium without moving in the main scanning direction unlike a serial-type recording head unit.

Figure 3:
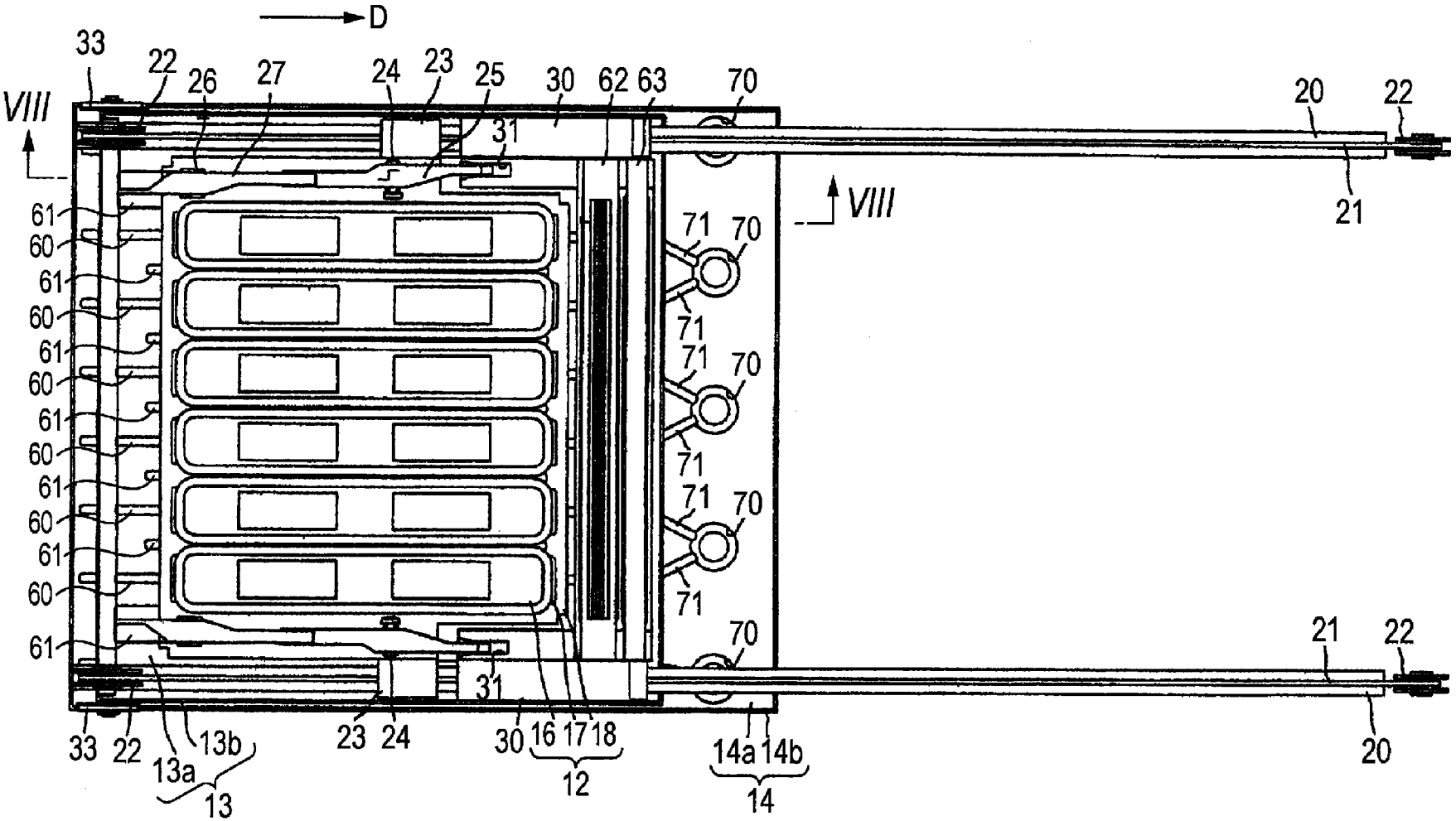
FIG. 3 is a plan view showing a cap unit, a first ink receiving unit, and a second ink receiving unit, which are in the state shown in FIG. 2.

Next, other parts of the image forming apparatus 1 will be described with reference to FIGS. 2 to 7. FIG. 2 is a cross-sectional view showing the internal configuration of the image forming apparatus 1 taken along a line II-II of FIG. 1. Moreover, an outer frame shown in FIG. 1 is not shown in FIG. 2. FIG. 3 is a plan view showing a cap unit 12, a first ink receiving unit 13 and a second ink receiving unit 14, which are in a state shown in FIG. 2.

Figure 4:
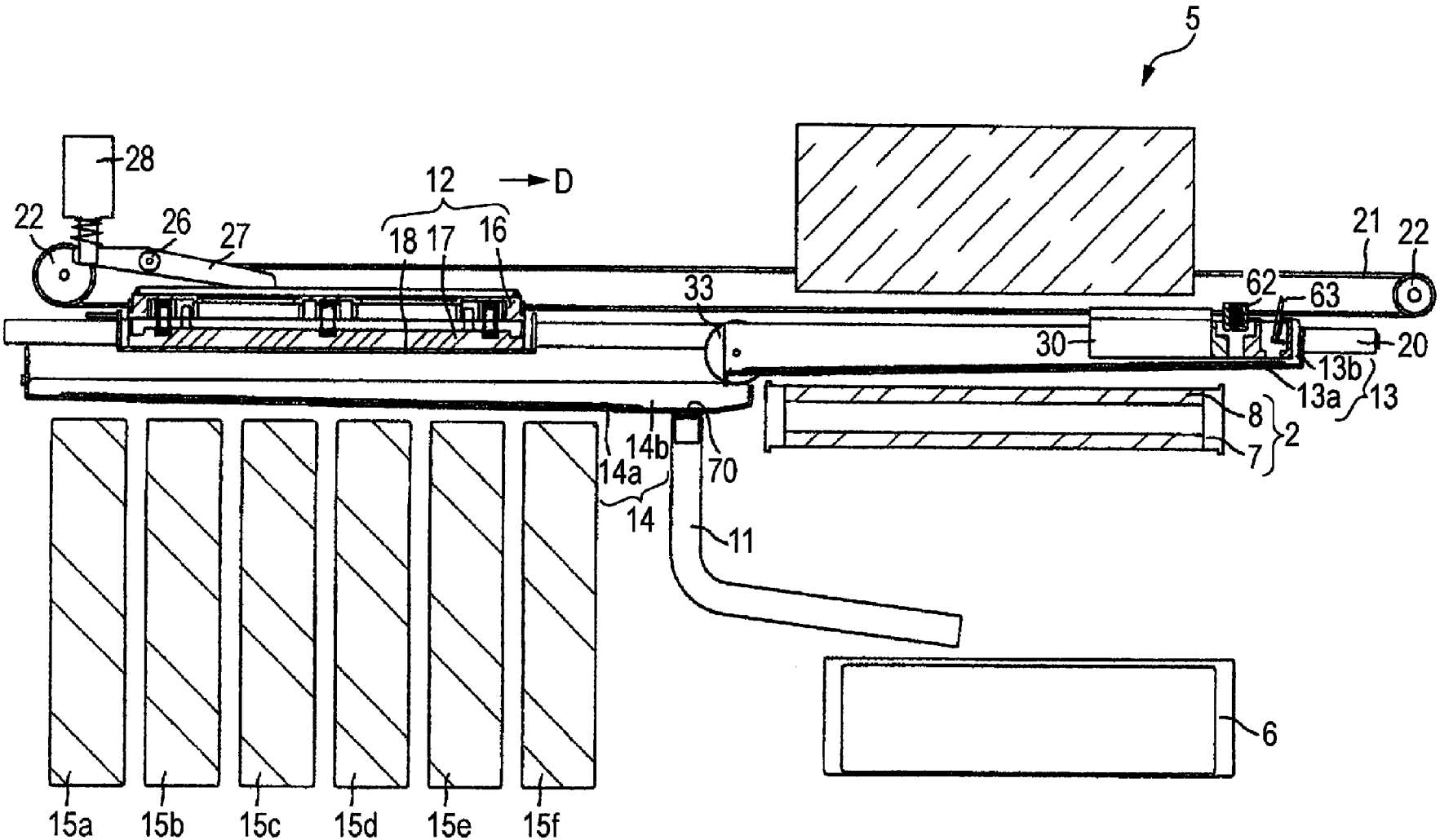
FIG. 4 corresponds to FIG. 2 and is a diagram showing a state where the first ink receiving unit, which is in the state shown in FIG. 2, is moved independently of the cap unit, toward a recording head unit 5.
Figure 5:
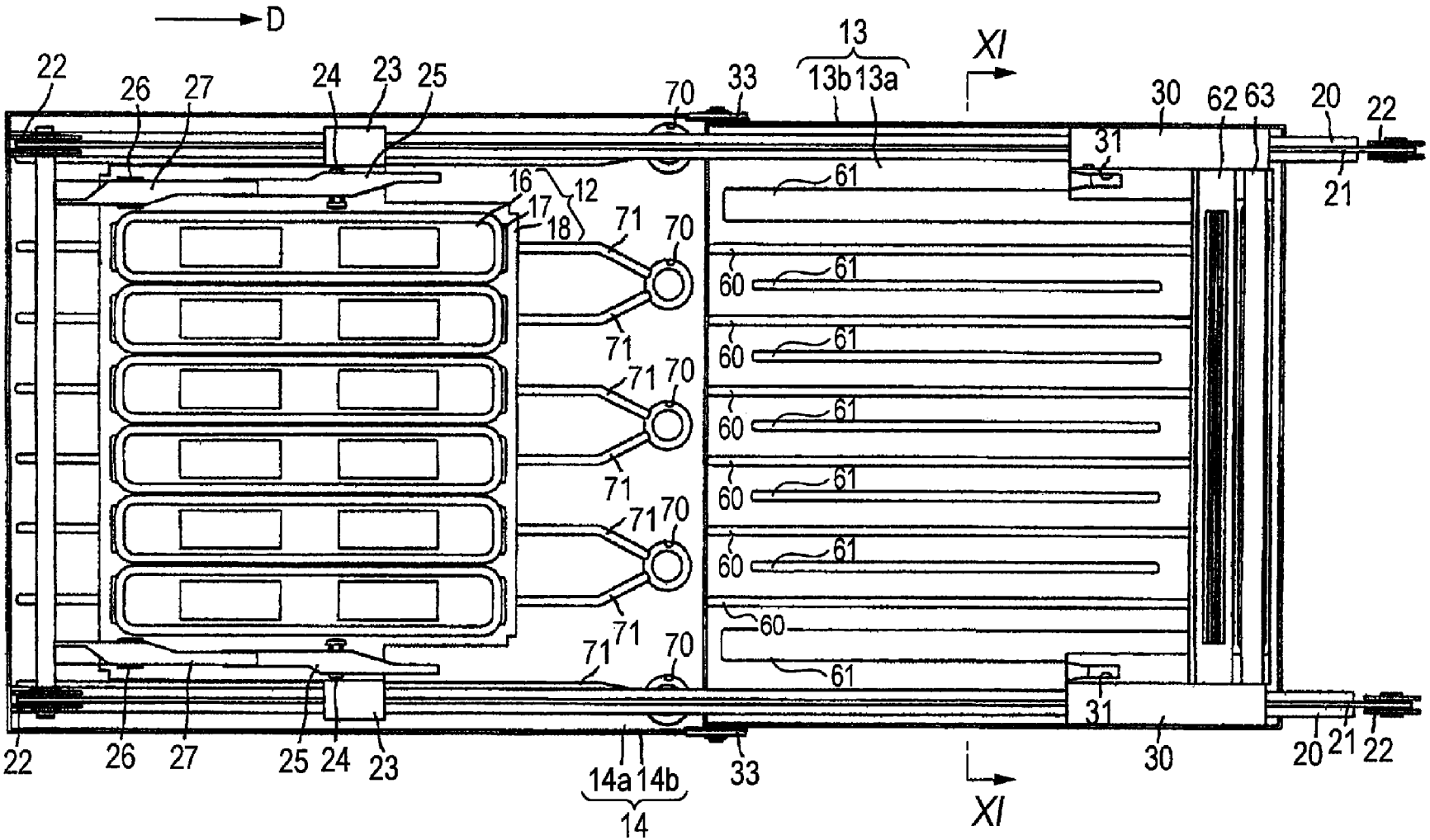
FIG. 5 is a plan view showing the cap unit, the first ink receiving unit, and the second ink receiving unit, which are in the state shown in FIG. 4.

FIG. 4 corresponds to FIG. 2 and is a diagram showing a state in which the first ink receiving unit 13, which is in the state shown in FIG. 2, is independently moved toward the recording head unit 5. FIG. 5 is a plan view showing the cap unit 12, the first ink receiving unit 13, and the second ink receiving unit 14, which are in the state shown in FIG. 4.

Figure 6:
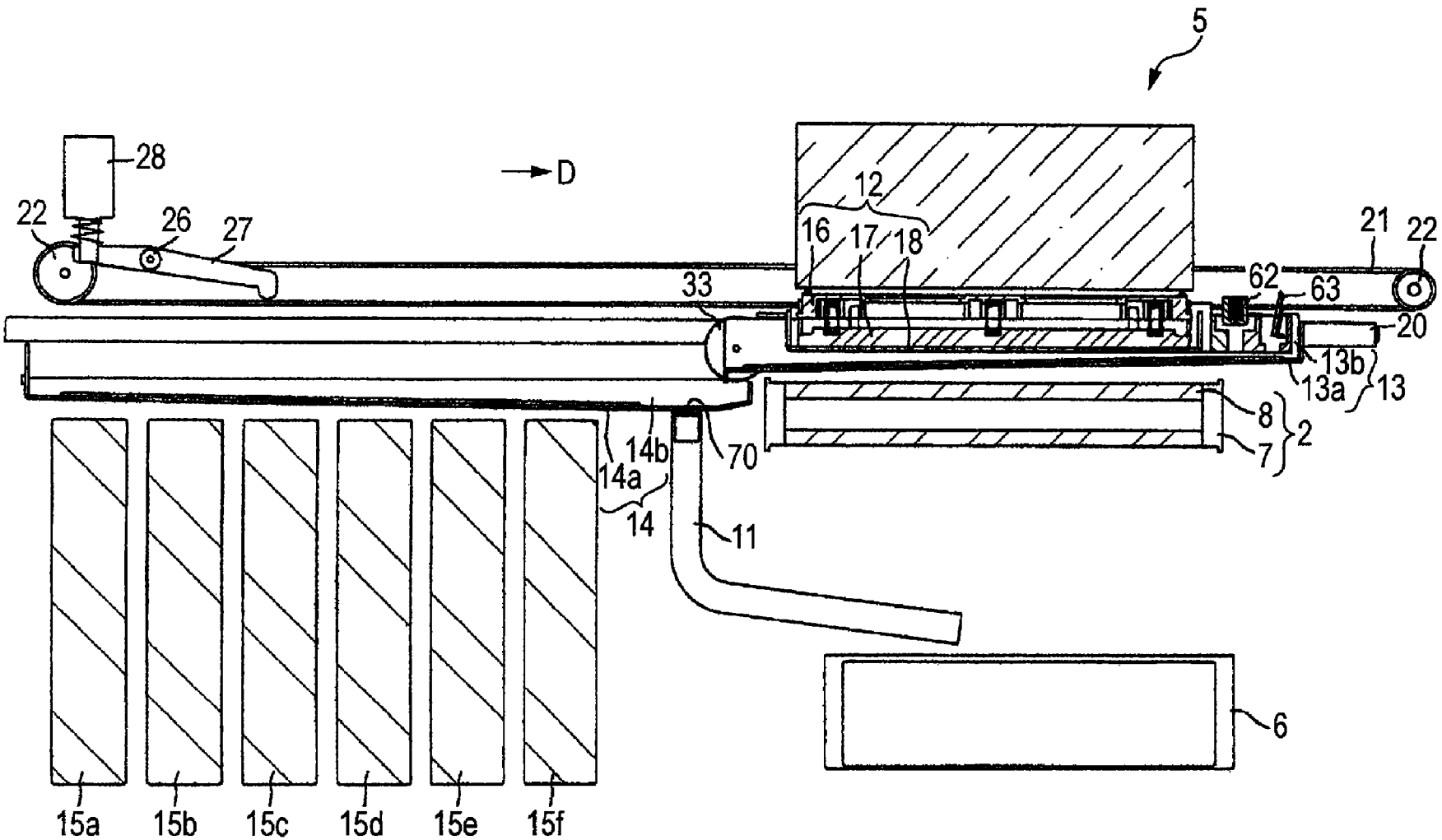
FIG. 6 corresponds to FIG. 2 and is a diagram showing a state where the cap unit, which is in the state shown in FIG. 2, is moved toward the recording head unit 5 integrally with the first ink receiving unit.
Figure 7:
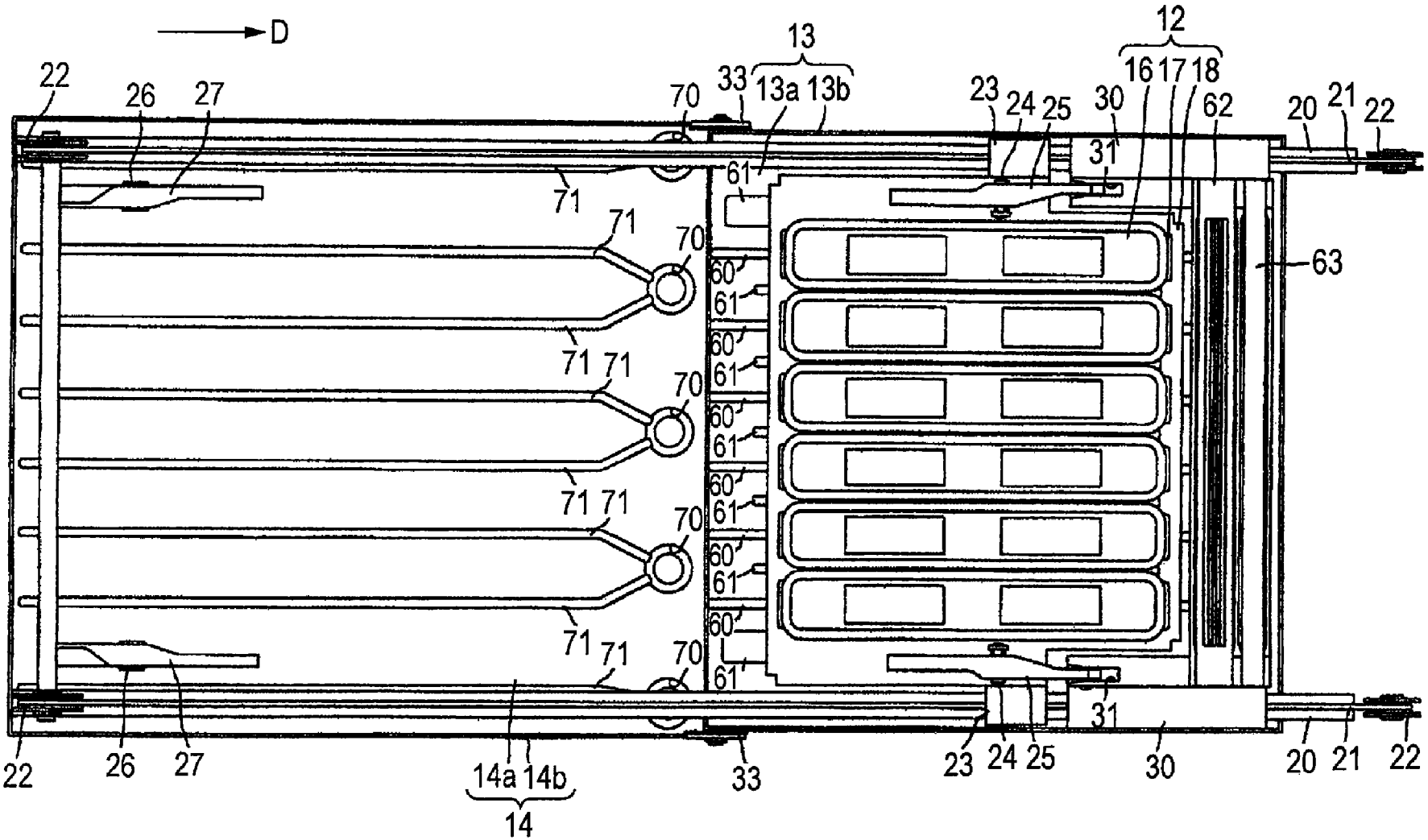
FIG. 7 is a plan view showing the cap unit, the first ink receiving unit, and the second ink receiving unit, which are in the state shown in FIG. 6.

FIG. 6 corresponds to FIG. 2 and is a diagram showing a state in which the cap unit 12, which is in the state shown in FIG. 2, is moved together with the first ink receiving unit 13 toward the recording head unit 5. FIG. 7 is a plan view showing the cap unit 12, the first ink receiving unit 13, and the second ink receiving unit 14, which are in the state shown in FIG. 6.

As shown in FIGS. 2 and 3, the image forming apparatus 1 has the cap unit 12, the first ink receiving unit 13, the second ink receiving unit 14, and six ink cartridges 15*a* to 15*f* beside the recording head unit 5 sequentially from the above, as well as the parts described with reference to FIG. 1.

The cap unit 12 abuts against the nozzle formation surface of each of the six recording heads 5*a* to 5*f* to form a closed space in which the nozzle formation surface is sealed off. The cap unit 12 has six cap main bodies 16, cap holders 17 and a cap tray 18. The cap main bodies 16 are arranged in parallel to correspond to the recording heads 5*a* to 5*f*. The cap holder 17 support the cap main bodies 16 while being spaced at predetermined intervals from the respective cap main bodies 16. The cap tray 18 supports the cap holders 17 from the below.

Further, the cap unit 12 can reciprocate between a non-capping position shown in FIGS. 2 to 5 and a capping position shown in FIGS. 6 and 7 in a direction of an arrow D (second direction), which is substantially perpendicular to the conveyance direction A (a first direction) of the recording medium (see FIG. 1), and a direction opposite to the arrow D with being integrated with the first ink receiving unit 13. Moreover, the cap unit 12 will be described specifically below.

The first ink receiving unit 13 firstly receives ink, which is ejected from the recording heads 5*a* to 5*f* during the purge operation. The first ink receiving unit 13 is formed in a substantially hollow box shape with an opened top surface. The first ink receiving unit 13 includes a bottom wall 13*a* constituting an ink receiving region, and side walls 13*b* provided upright from edges of the bottom wall 13*a* toward the recording head unit 5.

Further, the first ink receiving unit 13 is can reciprocate independently of the cap unit 12 between the non-capping position shown in FIGS. 2, 3, 6, and 7 and an ink receiving position shown in FIGS. 4 and 5 in the direction of the arrow D and the direction opposite to the arrow D. Moreover, the first ink receiving unit 13 will be described specifically below.

The second ink receiving unit 14 receives ink flowing from the first ink receiving unit 13 and introduces the received ink into the waste ink tank 6 through the tube 11. As shown in FIGS. 2 and 3, the second ink receiving unit 14 is fixedly arranged below the first ink receiving unit 13, which is moved to the ink non-receiving position. Further, the second ink receiving unit 14 is formed in a substantially hollow box shape with an opened top surface, and includes a bottom wall 14*a* constituting an ink receiving region, and side walls 14*b* provided upright from the edges of the bottom wall 14*a* toward the recording head unit 5. Moreover, the second ink receiving unit 14 will be described specifically below.

The six ink cartridges 15*a* to 15*f* stores the ink of six colors of cyan, magenta, yellow, black, light cyan, and light magenta to be supplied to the respective six recording heads 5*a* to 5*f*. The ink cartridges 15*a* to 15*f* are detachably connected to the image forming apparatus 1. If the ink cartridges 15*a* to 15*f* are mounted on the image forming apparatus 1, the ink cartridges 15*a* to 15*f* are connected to pumps (not shown), and the six kinds of ink stored in the ink cartridges 15*a* to 15*f* are respectively supplied to the recording heads 5*a* to 5*f* through the tubes (not shown) by the pumps (not shown).

The image forming apparatus 1 includes two guide rods 22 and pulleys 22 as parts of a moving mechanism for reciprocating the cap unit 12 and the first ink receiving unit 13. The two guide rods 20 extend in the direction of the arrow D, which is substantially perpendicular to the conveyance direction A of the recording medium (see FIG. 1), on both sides of the recording head unit 5 while crossing the conveyance belt 8. The pulleys 22 are disposed above both ends of each of the two guide rods 20. A belt 21 is stretched between the pulleys 22 in the extension direction of each guide rod 20.

Figure 8:
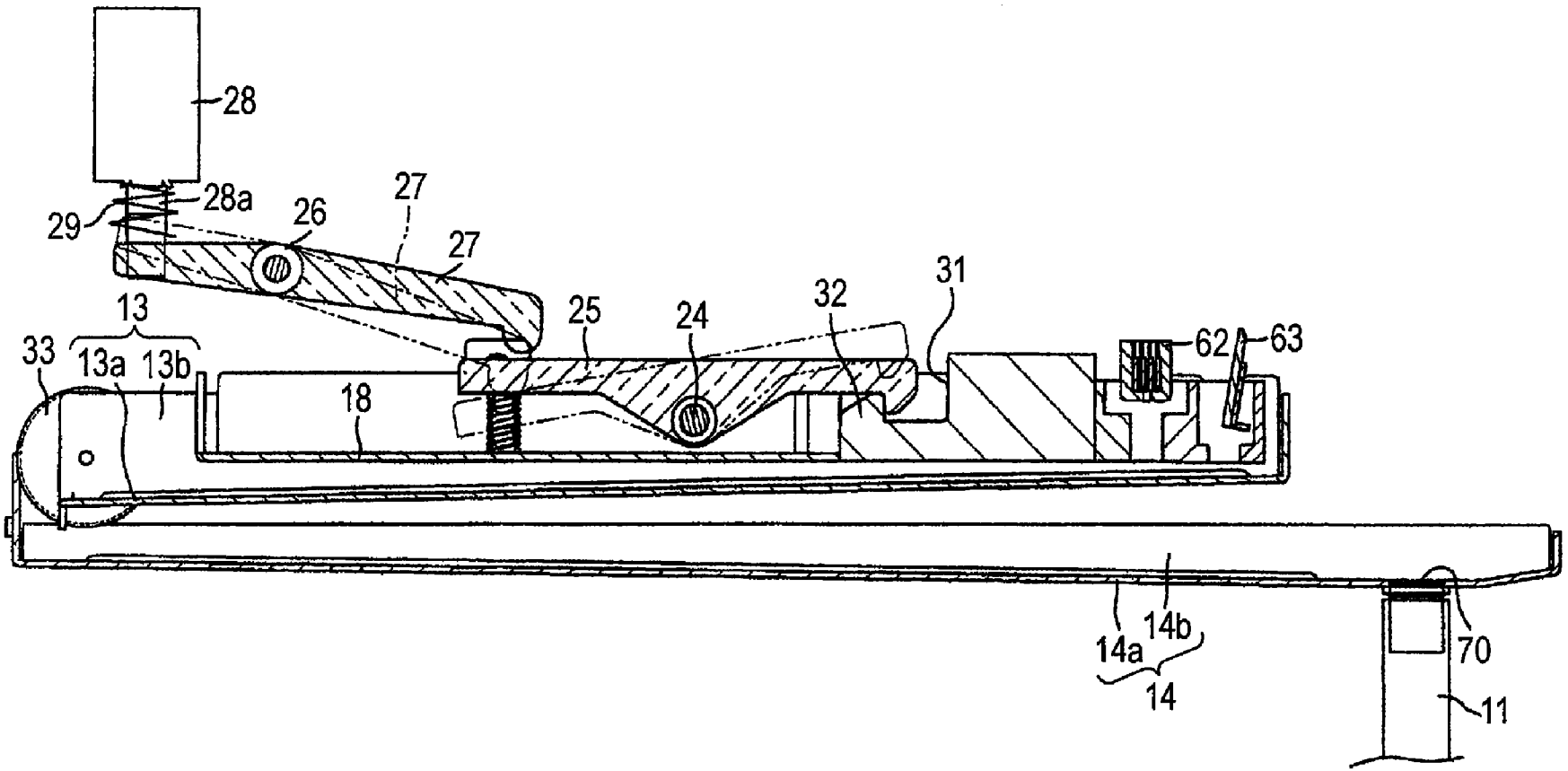
FIG. 8 is a cross-sectional view taken along a line VIII-VIII of FIG. 3.

Here, the moving mechanism for reciprocating the cap unit 12 and the first ink receiving unit 13 will be described with reference to FIG. 8 as well as FIGS. 2 to 7. FIG. 8 is a cross-sectional view taken along a line VIII-VIII of FIG. 3. Moreover, the guide rods 20, the pulleys 22, and the like are omitted in FIG. 8.

As shown in FIGS. 2, 3 and 8, first support members 23, through which the guide rods 20 pass loosely, are connected to the cap tray 18. Two engaging claws 25 are provided at positions adjacent to the first support members 23 inside the cap tray 18 so as to be vertically movable like a simple balance around support shafts 24. Further, seesaw members 27 are provided at ends of the engaging claws 25 so as to be vertically movable like a simple balance around support shafts 26. In addition, solenoids 28 (see FIG. 8) are connected to ends of the seesaw members 27.

Further, second support members 30 are connected to the ends of the side wall 13*b* of the first ink receiving unit 13 (on the recording head unit 5 side). The guide rods 20 pass through the second support members 30 loosely. The second support members 30 are connected to the belts 21. Engaging grooves 31, which are engaged with engaging claws 25, are formed in the second supporting member 30. Further, a wheel 33 is connected to the side wall 13*b* opposite to the side wall 13*b* to which the second support member 30 is connected, so as to roll along an upper edge of the side wall 14*b* of the second ink receiving unit 14.

First, a mechanism for connecting the cap unit 12 and the first ink receiving unit 13 will be described. When the first ink receiving unit 13, which is located at the ink receiving position as shown in FIGS. 4 and 5, is moved to the ink non-receiving position shown in FIGS. 2 and 3, the bottom wall 13*a* of the first ink receiving unit 13 enters below the cap tray 18 located at the non-capping position. Then, the engaging claws 25 (see a solid line of FIG. 8), which are in the substantially horizontal state within the cap tray 18, collide with bank portions 32, which are provided in the first ink receiving unit 13 and adjacent to the engaging grooves 31.

Then, the engaging claws 25 are displaced to be inclined right upward in FIG. 8 around the support shafts 24 by collision force (see a two-dot-chain line of FIG. 8). The engaging claws 25 slide over the bank portions 32 so as to be engaged with the engaging grooves 31. As a result, since the engaging claws 25 are engaged with the engaging grooves 31, the cap unit 12 having the engaging claws 25 is connected to the first ink receiving unit 13 having the engaging grooves 31.

Next, a case in which the cap unit 12 and the first ink receiving unit 13, which are in a state where the cap unit 12 and the first ink receiving unit 13 are connected to each other by the engaging claws 25 and the engaging grooves 31 as shown in FIGS. 2 and 3, are integrally moved to the position shown in FIGS. 6 and 7 will be described. When the cap unit 12 and the first ink receiving unit 13 are in the state shown in FIGS. 2 and 3, if a slide motor 92 (see FIG. 12) is driven, the pulleys 22 and the belts 21 are rotated through a transfer mechanism (not shown).

Then, since the second support members 30 connected to the belts 21 are moved toward the recording head unit 5 along the guide rods 20, the first ink receiving unit 13 connected to the second support members 30 is also moved toward the recording head unit 5. Accordingly, the cap unit 12 connected to the first ink receiving unit 13 is integrally moved toward the recording head unit 5. Then, as shown in FIGS. 6 and 7, the cap unit 12 stops at the capping position, and the first ink receiving unit 13 stops at the ink receiving position. Moreover, when the first ink receiving unit 13 is moved, the wheels 33 roll along the upper edges of the side walls 14*a* of the second ink receiving unit 14, such that the first ink receiving unit 13 is moved stably.

Next, a case in which the first ink receiving unit 13 is moved to the ink receiving position independently of the cap unit 12 in a state where the cap unit 12 and the first ink receiving unit 13 are connected to each other by the engaging claws 25 and the engaging grooves 31 as shown in FIGS. 2 and 3 will be described.

In this case, first, the solenoids 28 is activated to disengage the engaging claws 25 and the engaging grooves 31. As shown in FIG. 8, when the solenoids 28 is not activated, the seesaw members 27 are substantially maintained in the horizontal state (see a solid line of FIG. 8) by coil springs 29 passing through connection rods 28*a* of the solenoids 28. In this state, if the solenoids 28 is activated, the connection rods 28*a* are displaced upward against the coil springs 29, and the seesaw members 27 connected to the connection rods 28*a* are displaced around the support shafts 26 to be inclined right downward (see a two-dot-chain line of FIG. 8). Then, the other ends of the seesaw members 27 press the one ends of the engaging claws 25. Thus, the engaging claws 25 are displaced around the support shafts 24 to be inclined right upward (see the two-dot-chain line of FIG. 8). Accordingly, the engaging claws 25 engaged with the engaging grooves 31 are disengaged from the engaging grooves 31.

If the slide motor 92 (see FIG. 12) is driven in this state in a similar manner to the above description, since the engaging claws 25 have been disengaged from the engaging grooves 31, only the first ink receiving unit 13 is moved along the guide rods 20, and finally stops at the ink receiving position shown in FIGS. 4 and 5.

Next, the cap unit 12 will be described in detail with reference to FIGS. 2 to 7, and 9. FIG. 9A is an enlarged cross-sectional view showing a state where the lip portions 41 of the cap main body 16 abut against the nozzle formation surface. FIG. 9B is an enlarged cross-sectional view of the lip portion 41. FIG. 9C is an enlarged cross-sectional view of a film 43. Moreover, in FIG. 9A, the cap tray 18 is not shown.

The six cap main bodies 16 arranged in parallel on the cap tray 18 are arranged to correspond to the recording heads 5*a* to 5*f*, in the same direction as the arrangement direction in which the recording heads 5*a* to 5*f* are arranged, and at the same pitch as the arrangement pitch of the recording heads 5*a* to 5*f*.

As shown in FIG. 9A, each cap main body 16 has a plate-shaped base portion 40, the lip portions 41, openings 42, films 43, vertical walls 44, reinforcing walls 45 and engagement portions 46. The base portion 40 faces the nozzle formation surface of each of the recording heads 5*a* to 5*f*. The lip portions 41 are upright from peripheral edges of the base portion 40 toward the nozzle formation surface to be able to abut against the nozzle formation surface. The openings 42 pass through and open the base portion 40. The films 43 cover the openings 42. The vertical walls 44 extend from the peripheral edges of the base portion 40 in a direction opposite to the direction in which the lip portions 41 are upright. The reinforcing walls 45 extend inward from the inner surfaces of the vertical walls 44. The engagement portions 46 extend outward from lower ends of the vertical walls 44 in a lateral direction so as to be engaged with the cap holder 17.

Among the parts constituting each cap main body 16, parts except the lip portions 41 and the films 43 are integrally formed of resin. The lip portions 41 are formed of resin having larger elasticity than these parts and are fixed to the base portion 40 by thermal welding. Specifically, the lip portions 41 are formed of rubber having JIS A hardness in a range of from about 10 degrees to about 20 degrees. According to these properties of the lip portions 41, when the lip portions 41 abut against the nozzle formation surface, the lip portions 41 can be in close contact with the nozzle formation surface. Thus, air tightness of the closed space for closing the nozzle formation surface can be enhanced. Therefore, when the image forming apparatus 1 is not used, ink in the nozzles can be suppressed from being dried.

Further, as shown in FIG. 9B, the respective lip portions 41 are formed in a hill shape having one apex in cross-sectional view. A curvature R of the apex is about 1.0 mm. According to this structure of the lip portions 41, the lip portions 41 can be in further close contact with the nozzle formation surface.

Further, the maximum height h of each lip portion 41 is in a range of from about 1.0 mm to about 2.0 mm, and preferably, about 1.5 mm. The maximum width w of each lip portion 41 is in a range of from about 1.5 mm to about 2.5 mm, and preferably, about 2.0 mm. That is, the maximum height h of the lip portion is about 0.75 to 2.5 times, preferably about 1.3 times, as large as the maximum width w of the lip portion.

According to this structure of the lip portions 41, a space surrounded by the nozzle formation surface, the base portion 40, and the lip portions 41 can be made as small as possible. Therefore, it is further possible to prevent the ink from the nozzles from being dried, as much as possible. Further, when the lip portions 41 abut against the nozzle formation surface, the lip portions 41 can be prevented from being toppled left and right. Thus, the lip portions 41 can stably abut against the nozzle formation surface.

The image forming apparatus 1 is of the line head type as described above. Each of the recording heads 5*a* to 5*f* of the line head type has a large number of nozzles. Therefore, the purge operation for the recording head unit 5 of the line head type requires a larger amount of ink than a serial type recording head, which has less number of nozzles. If the purge operation is often performed, a quite larger amount of ink would be wasted. According to the lip portions 41, the ink in the nozzles is prevented from being dried as much as possible as described above, decreasing the number of times that the purge operation is required and performed. As a result, an amount of ink wasted in the purge operation can be decreased.

Each cap main body 16 is provided with the two openings 42. The number of the openings 42, the positions of the openings 42, and the like are not limited to this embodiment. For example, a plurality of openings 42 may be scattered in the base portion 40. Further, the base portion 40 maybe formed in a frame shape, and the entire inner portion of the frame may be formed as an opening.

As shown in FIG. 9C, each of the films 43 is formed by laminating four films of a nylon film 43*a*, an aluminum oxide layer 43*d*, a polyester film 43*b* on which the aluminum oxide 43*d* is deposited, and a polypropylene film 43*c* in order from the nozzle formation surface side.

Each of the films 43*a* to 43*c* is thin enough to have flexibility, and has gas barrier property. Further, the aluminum oxide 43*d* deposited on the polyester film 43*b* has high barrier property against vapor. Therefore, the film 43 has excellent shielding property against all kinds of gas and also has shielding property against any kind of ink, such as solvent-based ink or water-based ink. As such, by forming the film 43 to have the four-layered structure, a film having flexibility and gas shielding property can be simply implemented.

It is noted that the film 43 is not limited to a combination of the three layers 43*a* to 43*c* and the aluminum oxide 43*d*. The film 43 may have a lamination structure including at least one aluminum oxide layer 43*d* and another flexible layer. Also, the film 43 may have a plurality of aluminum oxide layers 43*d*.

In place of the aluminum oxide 43*d*, silicon oxide may be used. Both the aluminum oxide and the silicon oxide have high gas barrier property so long as they have at least a few Å in thickness.

The film 43 is welded to the base portion 40 so as to cover the openings 42. Thereby, in the case where the lip portions 41 abut against the nozzle formation surface (during capping), even if an internal pressure of the closed space defined by the nozzle formation surface, the base portion 40, and the lip portions 41, in which the nozzle formation surface is sealed off, is changed, the change in pressure can be absorbed by the films 43.

That is, before capping, the films 43 cover the openings 42 in plan view (see a solid line of FIG. 9A). After capping, the films 43 are made concave so as to be swelled toward an opposite side to the recording head unit 5 so that the change in pressure in the closed space is absorbed (see a two-dot-chain line of FIG. 9A).

As described above, the purge operation is performed by applying positive pressure to the respective nozzles of the recording heads 5*a* to 5*f*. In other words, the purge operation of this embodiment is a so-called "pressure purge." Therefore, it is not necessary to provide an incision in each film 43. To the contrary, a so-called "suction purge" requires a film to have an incision because the suction purge operation sucks through the incision of the film a closed space in which a nozzle formation surface is sealed off.

Further, even when an environmental temperature in surroundings is changed while the lip portions 41 abut against the nozzle formation surface (during capping), the internal pressure of the closed space is changed. However, like the above-described case, the change in pressure can be absorbed by the films 43. That is, when the environmental temperature rises, the films 43 are swelled toward the opposite side to the recording head unit 5 so as to absorb the change in pressure in the closed space. Further, when the environmental temperature falls, the films 43 are swelled toward the recording head unit 5 so as to absorb the change in pressure in the closed space. Accordingly, the meniscuses in the nozzles can be prevented from being damaged due to the change in pressure during capping. Thus, stable ink ejection performance can be maintained.

The films 43 have the gas shielding property for shielding gas. With this configuration, the ink is prevented from being dried due to gas, which transmits into the closed space in which the nozzle formation surface is sealed off and releasing a saturation state of the closed space.

The cap holder 17 has a plate-shaped substrate 50, a first erect walls 51 and second erect walls 52. The substrate is arranged at a position, which faces the base portion 40 of each cap main body 16 with a predetermined gap. The first erect walls 51 are upright toward the cap main body 16 from both ends of the substrate 50 in the width direction of the substrate 50. The first erect walls 51 have engagement holes for engaging with the engagement portions 46 of the cap main body 16. The second erect walls 52 are upright from the substrate 50 toward the cap main body 16, inside the first erect walls 51.

The cap main body 16 is placed on the first erect walls 51 with the predetermined gap from the substrate 50 while the engagement portions 46 of the cap main body 16 are inserted into the engagement holes of the first erect walls 51. Further, coil springs 53 are disposed between the base portions 40 of the cap main bodies 16 and the substrate 50. The coil springs 53 can absorb the pressure at the time of capping. The lip portions 41 can be pressed toward the nozzle formation surface, so that the lip portions 41 are in closer contact with the nozzle formation surface. In addition, the plurality of second erect walls 52 can prevent the cap main body 16 from being excessively pressed toward the substrate 50 at the time of capping.

In this exemplary embodiment, the three coil springs 53 support the base portion 40 of each cap main body 16 as shown in FIG. 9A. The total elastic force of the thee coil springs 53 is equal to 0.5 kgf. When capping the nozzle formation surface, each cap main body 16 (the lip portions 41) is stably pressed against the nozzle formation surface by the force of 0.5 kgf given by the tree coil springs 53.

On the other hand, the meniscus in the nozzles are destroyed with about 5 kPa or more. Assuming that the total elastic force of the three coil springs 53 is too great. In this case, the cap unit 12 does not open the closed space defined by the nozzle formation surface, the lip portions 41 and the base portion 40 during capping in which the nozzle formation surface is sealed off even if the inner pressure of the closed space exceeds 5 kPa. As a result, the meniscus in the nozzles would be destroyed due to the excess inner pressure of the closed space, necessitating the purge operation. In order to avoid such destruction of the meniscus due to the increased inner pressure of the closed space and avoid the purge operation, which wastes ink, the total elastic force of the three coil spring 53 is set to 0.5 kgf in the exemplary embodiment. In other words, the total elastic force of the coil springs 53 of the cap unit 12 is less than force, which the bottom surfaces of the cap main bodies 16 receive when the inner pressure of the closed space destroys the meniscus in the nozzles.

Specifically, each cap main body 16 has 124 mm (length)× 19 mm (width)×2 mm (depth). When the inner pressure of the closed space reaches 5 kPa, the base portion 40 and the films 43 receive force of about 1.20 kgf from the nozzle formation surface side. The total elastic force of the three coil spring 53, that is, 0.5 kgf is less than 1.20 kgf. Therefore, before reaching 5 kPa, the inner pressure of the closed space moves the cap main bodies 16 downward against the elastic force given by the three coil springs 53. As a result, the exemplary embodiment can avoid that the meniscus in the nozzles are destroyed in the case where the inner pressure of the closed space increases excessively during capping.

Figure 10:
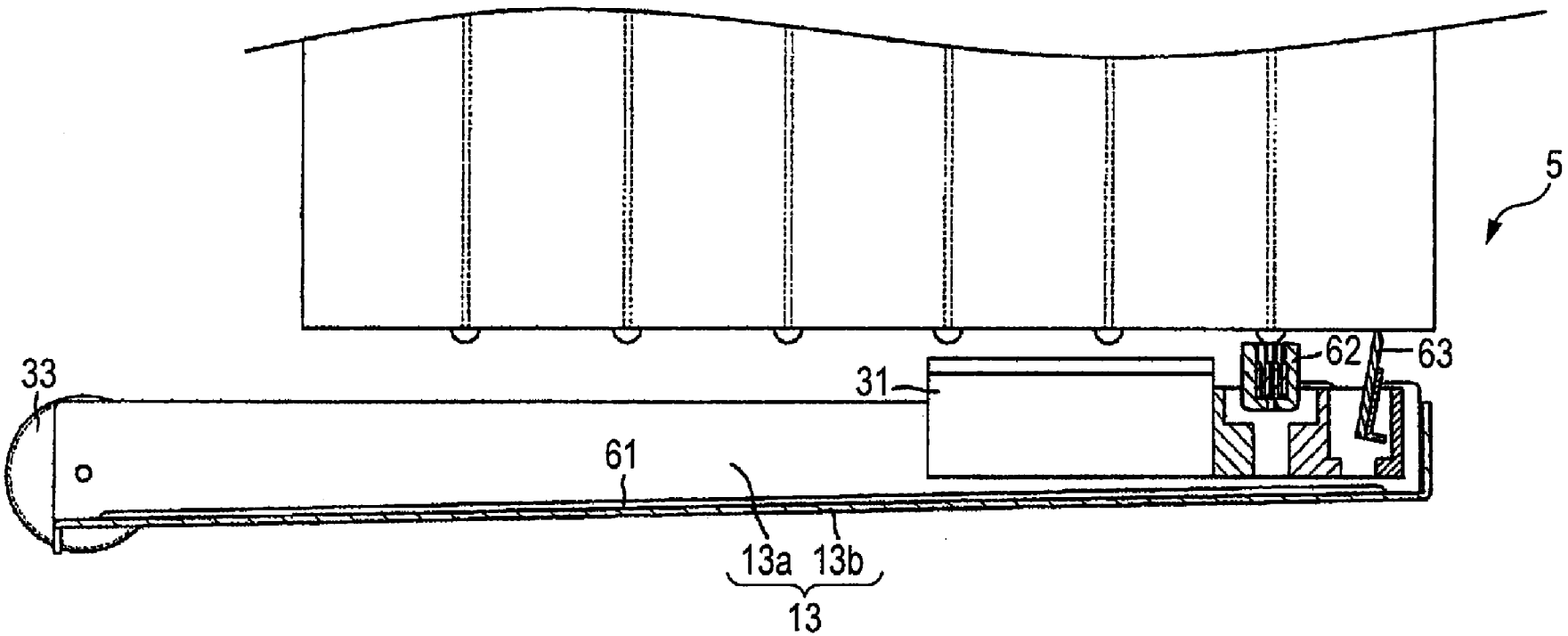
FIG. 10 is a cross-sectional view showing the first ink receiving unit, which is facing the recording head unit.
Figure 11:
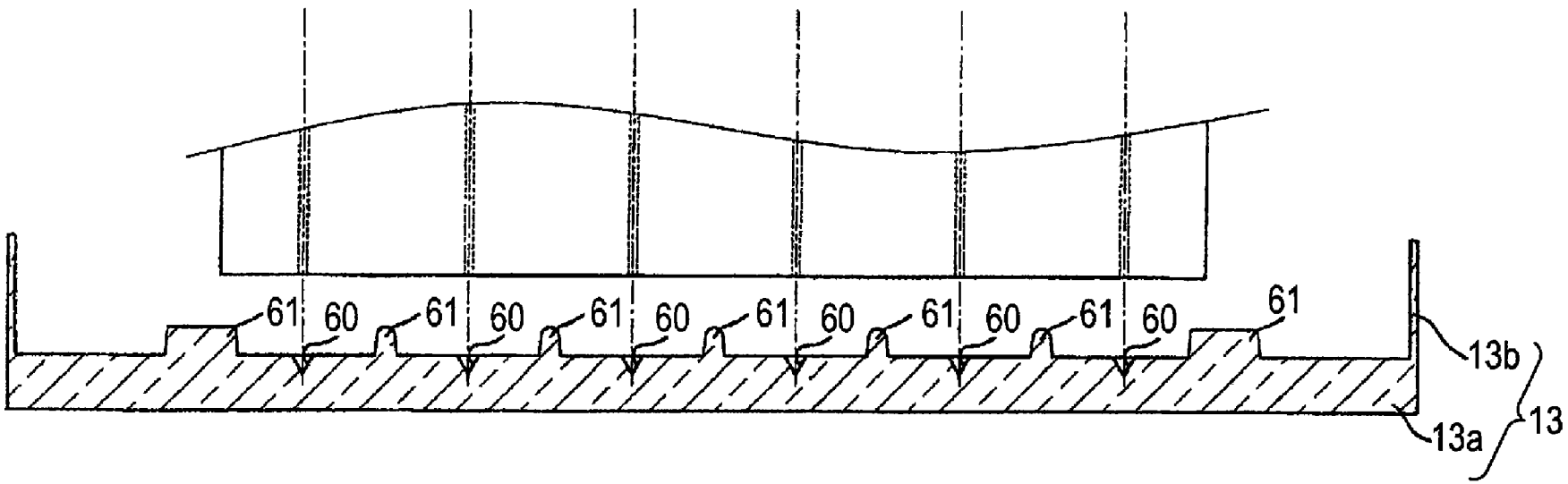
FIG. 11 is an enlarged cross-sectional view of the first ink receiving unit taken along a line XI-XI of FIG. 5.

Next, the first ink receiving unit 13 will be described in detail with reference to FIGS. 2 to 7, 10, and 11. FIG. 10 is a cross-sectional view of the first ink receiving unit 13, which is facing the recording head unit 5 (the first ink receiving unit 13 is located at the ink receiving position). FIG. 11 is an enlarged cross-sectional view of the first ink receiving unit 13 taken along a line XI-XI of FIG. 5.

The bottom wall 13*a* of the first ink receiving unit 13 is larger than an occupation region of the nozzles provided in the nozzle formation surfaces of the respective recording heads 5*a* to 5*f*. That is, even if ink is ejected from all nozzles of the respective recording heads 5*a* to 5*f* when the first ink receiving unit 13 is located at the ink receiving position, the bottom wall 13*a* of the first ink receiving unit 13 is configured to have such a size as to be able to receive ink ejected from the all nozzles.

Accordingly, the purge operation can be executed for the respective recording heads 5*a* to 5*f* at once. Thus, the purge operation can be executed at high speed, as compared with a case where the purge operation is executed for one recording head at a time.

Further, as shown in FIG. 3, the bottom wall 13*a* of the first ink receiving unit 13 is configured to have such a size as to overlap the entire cap unit 12 as viewed from a direction crossing the nozzle formation surface when the first ink receiving unit 13 is located at the ink non-receiving position. Accordingly, the first ink receiving unit 13 can be disposed at the ink non-receiving position compactly.

Further, the bottom wall 13*a* of the first ink receiving unit 13 is inclined downward from the ink receiving position toward the ink non-receiving position. Therefore, ink ejected by the purge operation onto the bottom wall 13*a* of the first ink receiving unit 13 located at the ink receiving position can smoothly flow toward the second ink receiving unit 14.

In addition, as shown in FIGS. 5, 10, and 11, six grooves 60 and seven ribs 61 are formed on the bottom wall 13*a*. The grooves 60 are depressed from the surface of the bottom wall 13*a*. The ribs 61 protrude from the surface of the bottom wall 13*a* to sandwich each groove 60 therebetween.

The grooves 60 causes ink ejected from the respective recording heads 5*a* to 5*f* to flow toward the ink non-receiving position. The grooves 60 extend substantially linearly along the moving direction of the first ink receiving unit 13. Further, as shown in FIG. 11, the sectional shape of each groove 60 is substantially a V shape. According to this structure of the grooves 60, ink can flow smoothly as compared with a case where the grooves 60 are substantially formed in U shapes.

Further, as shown in FIG. 11, in a state where the first ink receiving unit 13 has been moved to the ink receiving position, the grooves 60 are located just below the nozzles provided in the respective recording heads 5*a* to 5*f*. Accordingly, ink is ejected from the nozzles onto the grooves 60, and thus the ejected ink can flow smoothly along the grooves 60.

The ribs 61 guide ink ejected from the respective recording heads 5*a* to 5*f* into the predetermined groove 60, and extend linearly along the moving direction of the first ink receiving unit 13 so as to sandwich the groove 60 therebetween. The ribs 61 can prevent ink from leaking into adjacent grooves 60. That is, ink can be prevented from being concentrated on a particular groove 60.

The side walls 13*b* of the first ink receiving unit 13 are upright from three sides of the bottom wall 13*a*, that is, an edge of the bottom wall 13*a* close to the ink receiving position and edges of the bottom wall 13*a* along the two guide rods 20. In other words, the side walls 13*b* of the first ink receiving unit 13 are upright from the edges of the bottom wall 13*a* except an edge of the bottom wall 13*a* close to the ink non-receiving position.

Accordingly, ink ejected onto the bottom wall 13*a* by the purge operation can be prevented from leaking from the side close to the ink receiving position or the sides extending along the guide rods 20, and can flow toward the ink non-receiving position.

The first ink receiving unit 13 is provided with, in addition to the parts described above, a comb-shaped ink introducing member 62 and a wiper 63. The ink introducing member 62 is disposed on a front-end side close to the ink receiving position. The wiper 63 is disposed closer to the ink receiving position than the ink introducing member 62.

The ink introducing member 62 introduces ink, which adheres to the nozzle formation surface of each of the recording heads 5*a* to 5*f* by the purge operation, onto the bottom wall 13*a*. The ink introducing member 62 forms a comb-shaped channels, which communicate the recording head unit 5 side with the bottom wall 13*a* side and extend over the range of the recording heads 5*a* to 5*f* in a direction perpendicular to the moving direction of the first ink receiving unit 13.

According to the ink introducing member 62, as shown in FIG. 10, ink of a droplet shape adhering to the nozzle formation surface by the purge operation is introduced into the channels formed between the comb teeth by a capillary action when the first ink receiving unit 13 is moved in the direction opposite to the arrow D, and then is introduced onto the bottom wall 13*a* through the channels. Accordingly, the ink of the droplet shape adhering to the nozzle formation surface by the purge operation is removed. Therefore, the inside of the apparatus can be prevented from being polluted due to ink dripping into the apparatus.

The wiper 63 is able to abut against the nozzle formation surface so as to wipe ink adhering to the nozzle formation surface. When the first ink receiving unit 13 is moved from the ink receiving position to the ink non-receiving position, the wiper 63 is upright toward the nozzle formation surface so as to abut against the nozzle formation surface. The wiper 63 is formed of a rubber plate.

According to the wiper 63, ink adhering to the nozzle formation surface, which has not been removed by the ink introducing member 62, can be wiped by a front end of the wiper 63 abutting against the nozzle formation surface when the first ink receiving unit 13 is moved in the direction opposite to the arrow D. Moreover, ink wiped by the wiper 63 flows downward along the wiper 63 and flows onto the bottom wall 13*a*. Accordingly, ink, which has not been removed by only the ink introducing member 62, can be removed.

Next, the second ink receiving unit 14 will be described in detail with reference to FIGS. 2 to 7. As shown in FIG. 3, in a state where the first ink receiving unit 13 is located at the ink non-receiving position, the bottom wall 14*a* of the second ink receiving unit 14 is configured to have such a size as to overlap the entire bottom wall 13*a* of the first ink receiving unit 13 as viewed from the direction intersecting the nozzle formation surface. Accordingly, the first ink receiving unit 13 and the second ink receiving unit 14 are arranged compactly in the ink non-receiving position.

Further, as shown in FIG. 5, connection holes 70 passing through the bottom wall 14*a* are formed in the bottom wall 14*a* of the second ink receiving unit 14. The connection holes 70 introduces ink, which flows from the bottom wall 13*a* of the first ink receiving unit 13 onto the bottom wall 14*a* of the second ink receiving unit 14, into the waste ink tank 6 through the tube 11.

As shown in FIG. 5, the connection holes 70 are arranged on the front-end side of the bottom wall 14*a* in the direction along the guide rods 20 and on extension lines of the grooves 60 of the first ink receiving unit 13, which has been moved to the ink receiving unit. By arranging the connection holes 70 at those positions, ink flowing to the second ink receiving unit 14 through the grooves 60 of the first ink receiving unit 13 can rapidly flow into the connection holes 70. Further, as shown in FIG. 4, since the bottom wall 14*a* is inclined downward toward the connection holes 70, ink on the bottom wall 14*a* can be smoothly introduced into the connection holes 70.

In addition, as shown in FIG. 5, grooves 71, which extend substantially linearly from the connection holes 70 along the extension direction of the guide rods 20 and are depressed from the surface of the bottom wall 14*a*, are formed in the bottom wall 14*a*. The grooves 71 introduce ink, which flows onto the bottom wall 14*a*, into the connection holes 70. Like the grooves 60 formed in the first ink receiving unit 13, each of the grooves 71 has a substantial V shape in a cross section. Accordingly, ink can be smoothly introduced into the connection holes 70.

As such, in addition to the first ink receiving unit 13, the second ink receiving unit 14 is thus configured and arranged. For example, if the second ink receiving unit 14 is not provided, it is conceivable that a tube may be connected to the first ink receiving unit, and that ink may be directly discharged from the tube to the waste ink tank 6. In this case, however, since the first ink receiving unit 13 is configured to reciprocate, the connected tube may be disconnected. To the contrary, since the fixed second ink receiving unit 14 is provided, ink ejected onto the first ink receiving unit 13 flows to the second ink receiving unit. Thus, the occurrence of the above-described problem can be prevented.

Figure 12:
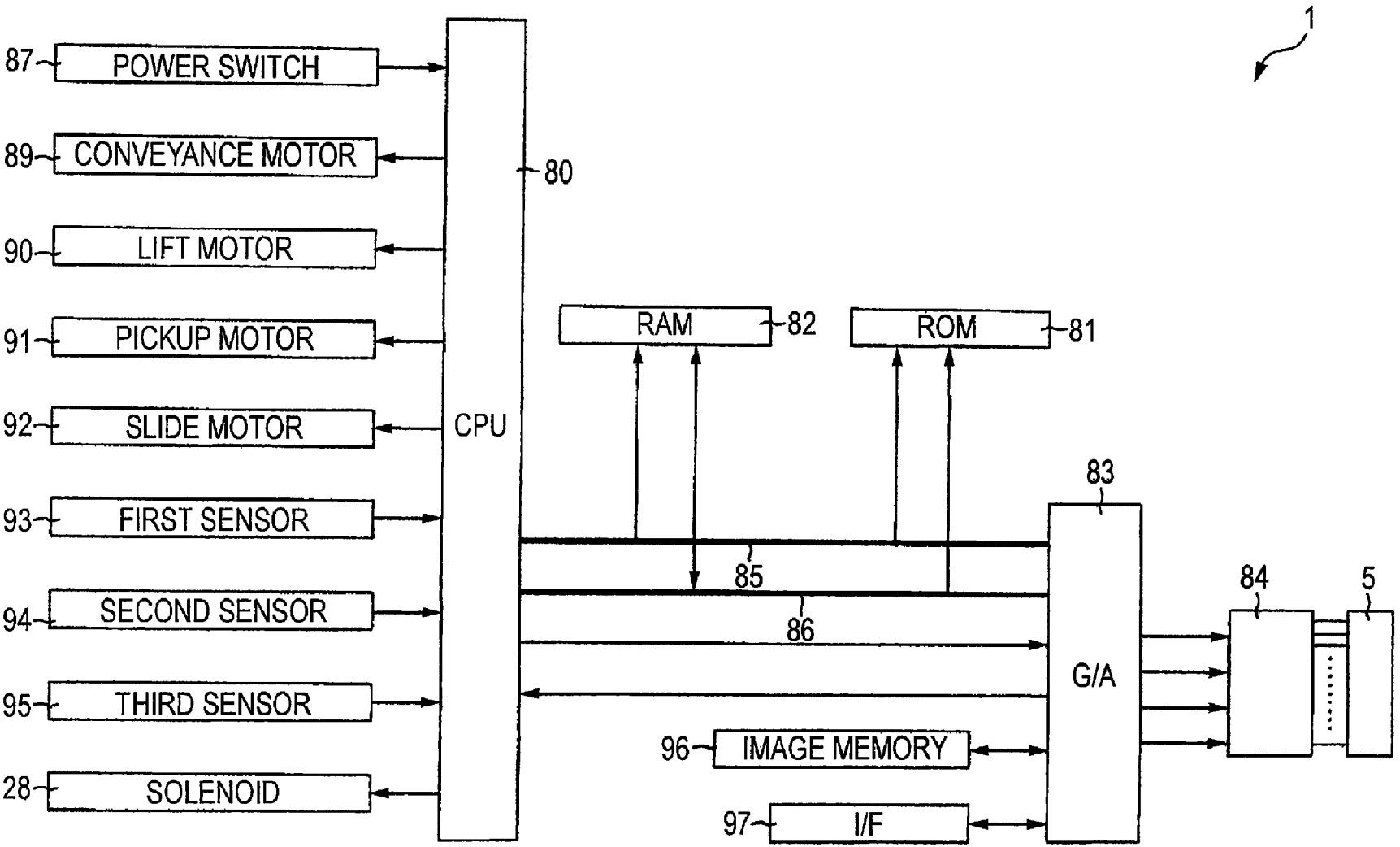
FIG. 12 is a block diagram showing the electrical configuration of the image forming apparatus.

Next, the electrical configuration of the image forming apparatus 1 will be described with reference to FIG. 12. FIG. 12 is a block diagram showing the electrical configuration of the image forming apparatus 1.

On the image forming apparatus 1, an one-chip micro computer (CPU) 80, a ROM 81, a RAM 82, a gate array (G/A) 83, a head driver 84, and the like are mounted. Moreover, the CPU 80, the ROM 81, the RAM 82, the gate array 83, and the head driver 84 are connected to one another through an address bus 85 and a data bus 86.

The CPU 80 serving as an arithmetic device executes controls of detecting, for example, ejection timing of ink, a residual quantity of ink and presence/absence of ink in the ink cartridge, according to a control program stored in the ROM 81 in advance. Further, the CPU 80 generates an ink ejection timing signal and a reset signal, and transmits these signals to the gate array 83 described below.

Further, a power switch 87, the conveyance motor 89, a lift motor 90, a pickup motor 91, a slide motor 92, first to third sensors 93-95 and the solenoid 28 are connected to the CPU 80. The power switch 87 supplies or cuts off power to the image forming apparatus 1. The conveyance motor 89 serves as a driving source for driving the conveyance rollers 7. The lift motor 90 serves as a driving source for driving the lift device 9. The pickup motor 91 serves as a driving source for driving the pickup roller 10. The slide motor 92 serves as for driving the first ink receiving unit 13. The CPU 80 controls the operation of each device.

The first sensor 93 detects whether or not the cap unit 12 is located at the non-capping position. The second sensor 94 detects whether or not the first ink receiving unit 13 is located at the ink non-receiving position. The third sensor 95 detects whether or not the first ink receiving unit 13 (the cap unit 12) is located at the ink receiving position. The CPU 80 monitors the output of each sensor to thereby check the state of the cap unit 12 and the like. Further, since the CPU 80 monitors the output of each sensor, for example, when the first ink receiving unit 13 is not located at the ink receiving position, ink is prevented from being ejected from the nozzles. Thus, the inside of the apparatus can be prevented from being polluted.

The ROM 81 is a non-rewritable nonvolatile memory, and stores various control programs for controlling the ejection of ink droplets to be executed by the CPU 80, and fixed-value data. The RAM 82 is a rewritable volatile memory, and temporarily stores various kinds of data or the like.

On the basis of image data stored in an image memory 96, the gate array 83 outputs image data (driving signals) for recording the stored image data onto the recording medium, a transmission clock CLK in synchronization with the image data, a latch signal, a parameter signal for generating a basic image waveform signal, and a jet timing signal JET output at a predetermined cycle according to a print timing signal to be transmitted from the CPU 80, and outputs these signals to the head driver 84. Further, the gate array 83 stores image data transmitted from an external device through an interface (I/F) 97 in the image memory 96.

According to the signals output from the gate array 83, the head driver 84 serving as a driving circuit applies driving pulses having waveforms corresponding to the signals to driving elements corresponding to the respective nozzles. The driving elements are driven by the driving pulses, and then ink is ejected from the respective nozzles.

Next, the operation of the recording head unit 5 at the time of purging or capping will be described with reference to FIGS. 13A to 13D. In FIGS. 13A to 13D, for the purpose of facilitating understanding, the cap unit 12 and the like are schematically shown.

Figure 13A:
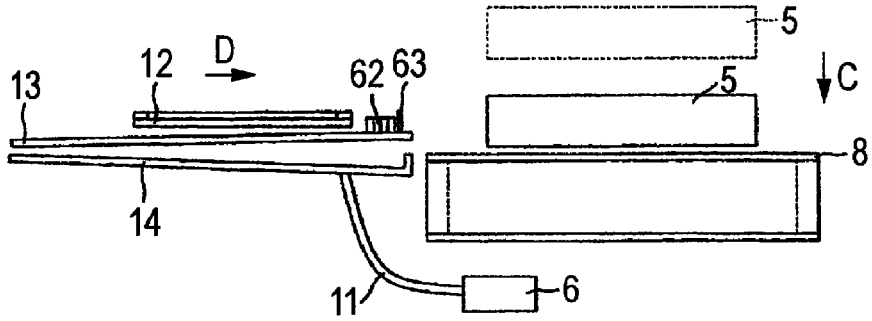
FIGS. 13A to 13D are diagrams illustrating the operations of the recording head unit and the like at the time of purging or capping.

FIG. 13A shows a state where ink is ejected from the recording head unit 5 to form an image on the recording medium on the conveyance belt 8. In this case, the recording head unit 5 is located at a position close to the conveyance belt 8, and the cap unit 12, the first ink receiving unit 13 and the second ink receiving unit 14 are located beside the recording head unit 5. Moreover, at this time, since the cap unit 12, the first ink receiving unit 13 and the second ink receiving unit 14 vertically overlap one another, the cap unit 12, the first ink receiving unit 13 and the second ink receiving unit 14 can be compactly arranged.

Figure 13B:
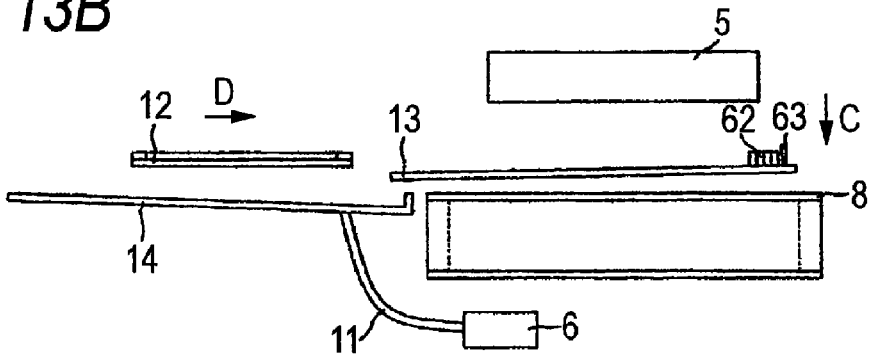
Figure 13C:
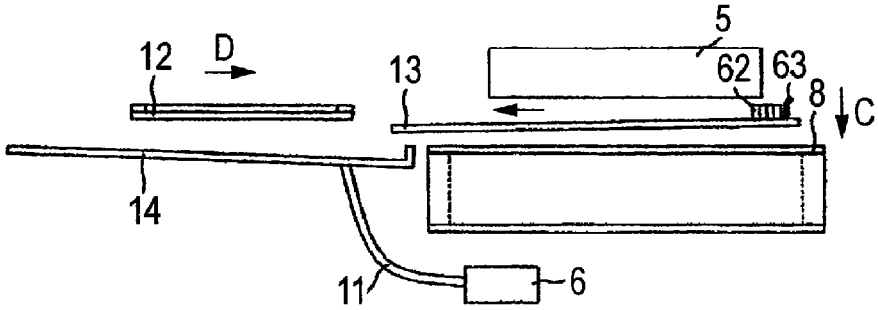

FIGS. 13B and 13C show the states of the recording head unit 5, the first ink receiving unit 13, and the like during the purge operation. When the purge operation starts, as shown in FIG. 13B, the recording head unit 5 is moved from the position shown in FIG. 13A in a direction opposite to an arrow C (a direction distant from the conveyance belt 8). Then, only the first ink receiving unit 13 is moved in the direction of the arrow D toward a space between the recording head unit 5 and the conveyance belt 8.

Next, as shown in FIG. 13C, the recording head unit 5 is moved again in the direction of the arrow C so that the respective nozzle formation surfaces of the recording head unit 5 abut against the end of the wiper 63 of the first ink receiving unit 13. Then, a higher pressure than that at the time of normal ink ejection is applied to the recording head unit 5 to eject ink from the nozzles toward the first ink receiving unit 13.

Subsequently, when the first ink receiving unit 13 is moved in the direction opposite to the arrow D, ink of a droplet shape adhering to the nozzle formation surfaces flows onto the first ink receiving unit 13 through the channels between the comb teeth formed in the ink introducing member 62. Then, ink adhering to the nozzle formation surfaces is wiped by the wiper 63, and flows onto the first ink receiving unit 13 along the wiper 13.

On the other hand, ink on the first ink receiving unit 13 flows toward the ink non-receiving position along the grooves 60 on the first ink receiving unit 13, and then flows onto the second ink receiving unit 14. Moreover, as shown in FIG. 4, in the state where the first ink receiving unit 13 is located at the ink receiving position, the end of the second ink receiving unit 14 on the ink receiving position side extends below the end of the first ink receiving unit 13 on the ink non-receiving position side. Accordingly, ink flowing from the ink non-receiving position side of the first ink receiving unit 13 can reliably fall onto the second ink receiving unit 14. Accordingly, ink falling onto the second ink receiving unit 14 is stored in the waste ink tank 6 through the tube 11.

Figure 13D:
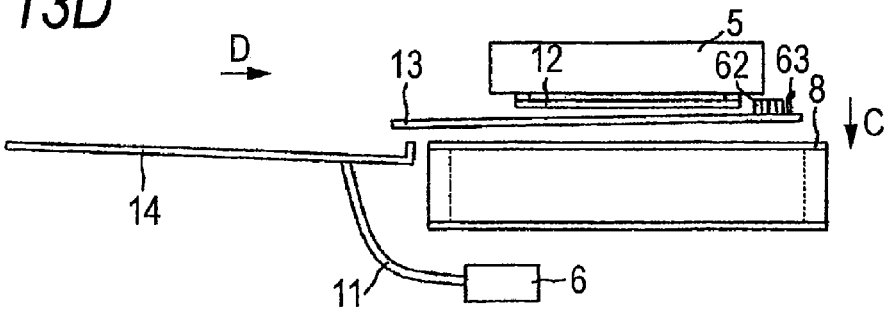

FIG. 13D is a diagram showing the states of the recording head unit 5, the cap unit 12, and the like at the time of capping. At the time of capping, first, as described with reference to FIG. 13B, the recording head unit 5 is moved from the position shown in FIG. 13A in the direction opposite to the arrow C (the direction distant from the conveyance belt 8).

Then, the cap unit 12 is moved in the direction of the arrow D together with the first ink receiving unit 13 toward a position between the recording head unit 5 and the conveyance belt 8. Subsequently, if the cap unit 12 reaches a predetermined capping position, the recording head unit 5 is moved in the direction of the arrow C so that the nozzle formation surfaces of the recording head unit 5 abut against the lip portions 41 of the cap unit 12. Thus, the closed space in which the nozzle formation surfaces is sealed off is formed.

Moreover, as for the operation from the capping state shown in FIG. 13D to the state shown in FIG. 13A, the recording head unit 5 is moved in the direction opposite to the arrow C, while the cap unit 12 is moved in the direction opposite to the arrow D together with the first ink receiving unit 13. Then, the recording head unit 5 is moved to the position shown in FIG. 13A again in the direction of the arrow C.

Figure 14A:
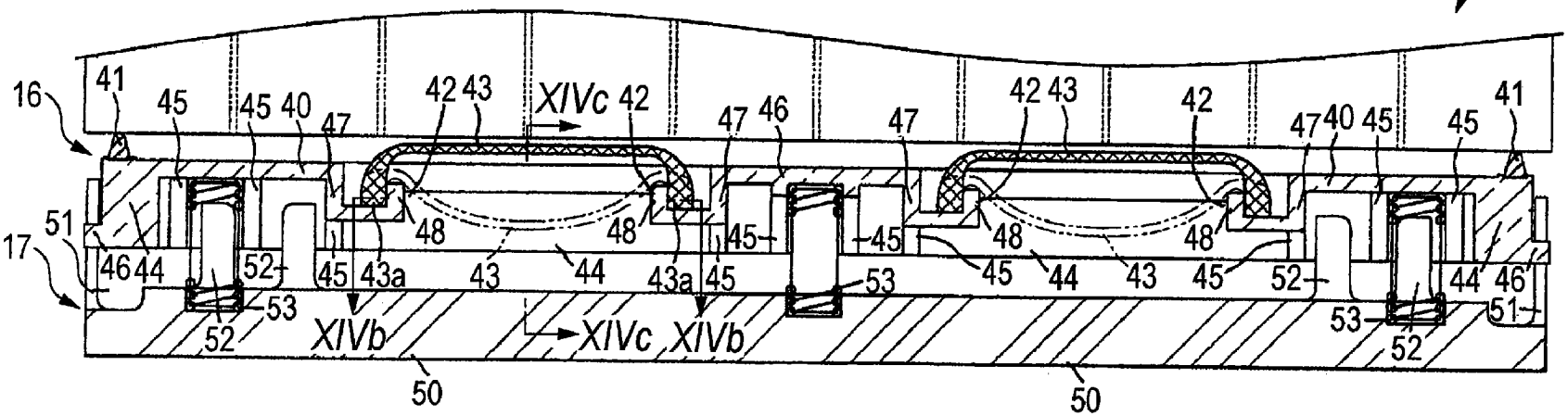
FIG. 14A corresponds to FIG. 9A and is an enlarged cross-sectional view showing a state where the lip portions of the cap main body abut against the nozzle formation surface.
Figure 14B:
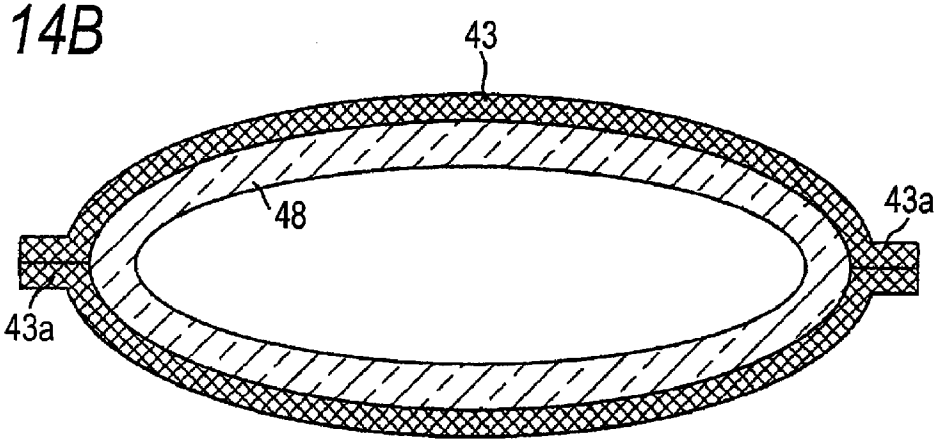
FIG. 14B is an enlarged cross-sectional view taken along a line XIVb-XIVb of FIG. 14A.
Figure 14C:
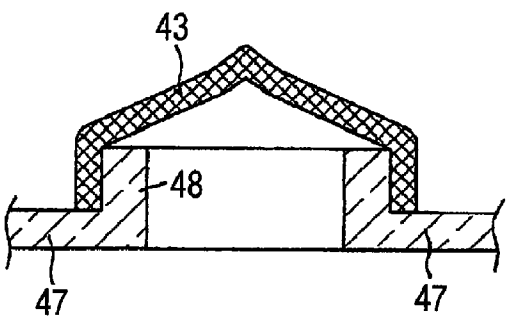
FIG. 14C is an enlarged cross-sectional view taken along a line XIVc-XIVc of FIG. 14A.

Next, a method of arranging a film 43 according to a second embodiment will be described with reference to FIGS. 14A to 14C. FIG. 14A corresponds to FIG. 9A and is an enlarged cross-sectional view showing a state where the lip portions 41 of the cap main body 16 abut against the nozzle formation surface. FIG. 14B is an enlarged cross-sectional view taken along a XIVb-XIVb of FIG. 14A. FIG. 14C is an enlarged cross-sectional view taken along a line XIVc-XIVc of FIG. 14A. Moreover, the same parts as those in the above-described embodiment are represented by the same reference numerals, and the descriptions thereof will be omitted.

In the above-described embodiment, the case where the flat plate-shaped films 43 cover the openings 42, which pass through and open the base portion 40 of the cap main body 16, has been described. In the arrangement method of the film 43 according to the second embodiment, a case where the film 43 is arranged in a dome shape (three-dimensional shape) will be described.

The film 43 is configured to be a bag shape by bending one plate-shaped film in double and sealing both edges except a portion opposite to the bent portion.

Further, concave portions 47 are formed in the base portion 40. The concave portions 47 are depressed so as to be more distant from the nozzle formation surface of the recording head unit 5 than the surface on which the lip portions 41. The openings 42 pass through the bottom surfaces of the concave portions 47 and are substantially formed in elliptic shapes in plan view as shown in FIG. 14B. In addition, protrusions 48 are formed on the bottom surface of each of the concave portions 47. The protrusions 48 surround the openings 42 and protrude toward the nozzle formation surface. The films 43 cover the protrusion 48 so that the bent portion faces the recording head unit 5, and thus the film 43 is formed in the dome shape, which is swelled toward the nozzle formation surface. The inner surfaces of the end portions of the films 43 are welded to the outer surfaces of the protrusions 48.

If the films 43 are arranged in such a method, when capping, the film 43 welded to be in the dome shape is swelled toward the opposite side to the nozzle formation surface as shown in a two-dot-chain line of FIG. 14A, due to the change in pressure at the time of capping, thereby absorbing the change in pressure. Accordingly, a movable range of the films 43 can be increased, as compared with the case where the films 43 are arranged in the flat plate shape as in the above-described embodiment. Thus, the films 43 can cope with a great change in pressure. Therefore, the meniscus can be reliably prevented from being destroyed. Further, even when an environmental temperature is changed during capping, the change in pressure in the closed space can be absorbed, like the above-described embodiment.

Figure 15:
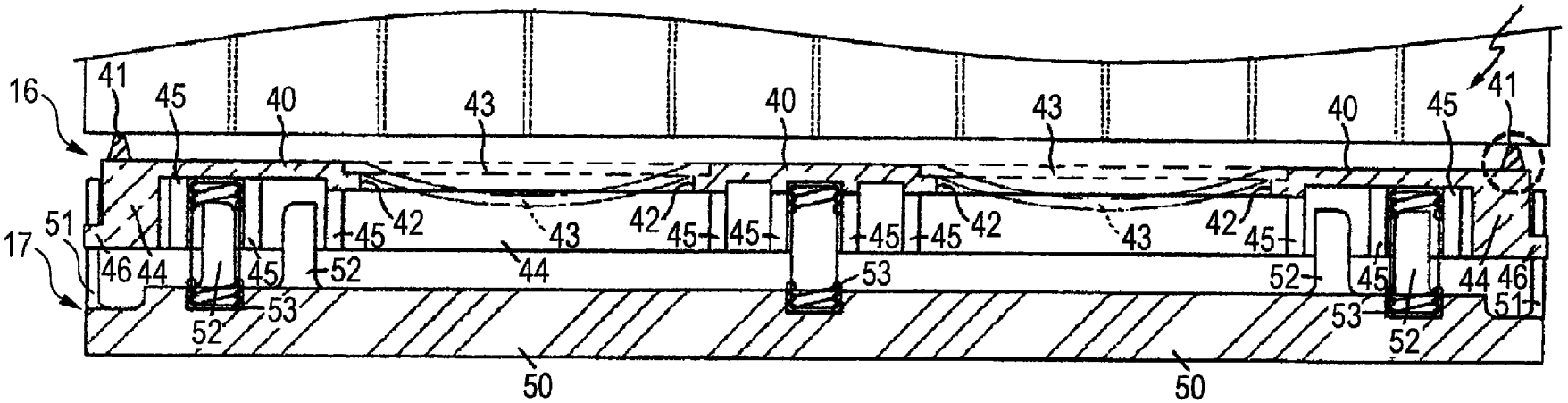
FIG. 15 corresponds to FIG. 9A and is an enlarged cross-sectional view showing a state where the lip portions of the cap main body abut against the nozzle formation surface.

Next, a method of arranging the film 43 according to a third embodiment will be described with reference to FIG. 15. FIG. 15 corresponds to FIG. 9A and is an enlarged cross-sectional view showing a state where the lip portions 41 of the cap main body 16 abut against the nozzle formation surface. The same parts as those in the above-described embodiments are represented by the same reference numerals, and the descriptions thereof will be omitted.

In the first embodiment, the film 43 is arranged to have a flat shape in section view initially as shown in FIG. 9A. In the third embodiment, the film 43 is arranged to have a convex shape protruding away from the nozzle formation surface in as section view taken along a direction in which the nozzles eject the ink toward the recording medium, as shown in FIG. 15.

End portions of the film 43 are welded to the base portion 40 and the film 43 has the convex shape protruding away from the nozzle formation surface, as shown by a solid line in FIG. 15. In other words, the film 43 is convex to be distant from the nozzle formation surface, initially. When capping, the film 43 is swelled toward the opposite side to the nozzle formation surface due to the change in pressure at the time of capping, thereby absorbing the change in pressure. Assuming that negative pressure occurs in the closed space during capping. The negative pressure pulls the film 43 toward the nozzle formation surface side. In this case, since the film 43 is arranged to initially have the convex shape protruding away from the nozzle formation surface in the section view, the film 43 is deformed to be flat as shown by a dashed line of FIG. 15. Even if stronger negative pressure occurs, the film 43 is deformed to be convex upward to absorb the negative pressure without contacting with the nozzle formation surface and the nozzles. Accordingly, there is less chance that the meniscus in the nozzles are destroyed due to contact between the film 43 and the nozzle formation surface.

The invention has been described based on the exemplary embodiments, but is not limited to the exemplary embodiments. Various modifications can be made within a range not departing from the subject matter of the invention.

For example, the cap unit 12 and the first ink receiving unit 13 are integrally moved for the sake of capping, while only the first ink receiving unit 13 is moved in the purge operation. At this time, smaller torque is required when only the first ink receiving unit 13 is moved. Accordingly, the slide motor 92 serving as the driving source for driving the first ink receiving unit 13 may be a stepping motor. Then, when only the first ink receiving unit 13 is moved, the output interval of the driving pulse may be shortened. Thus, the moving time of the first ink receiving unit 13 at the time of the purge operation can be reduced. As a result, the purge operation can be executed at high speed.

Further, like the first ink receiving unit 13, ribs may be provided in the second ink receiving unit 14 so as to sandwich the groove 71 therebetween. In this case, ink can be prevented from leaking to adjacent grooves 71, and thus ink can smoothly flow.

Further, in the above-described embodiments, a case where the six connection holes 70 are provided in the second ink receiving unit 14, the tube 11 is connected to the respective connection holes 70, and ink is introduced into the waste ink tank 6 through the tube 11 has been described. However, instead of the six connection holes 70, one through hole may be provided. In this case, the tube 11 does not need to be connected to the respective connection holes 70, and thus the number of parts can be reduced.

In addition, a frame may be provided in the upper edge of the side wall 13*b* of the first ink receiving unit 13 so as to extend inward. In this case, ink can be prevented from flying into the image forming apparatus 1 from the first ink receiving unit 13.

Also, in the third embodiment, the film 43 is disposed so as to have the convex shape protruding away from the nozzle formation surface in the section view take along a direction in which the nozzles eject the ink toward the recording medium. Alternatively, the film 43 may have a convex shape protruding toward the nozzle formation surface in the section view take along a direction in which the nozzles eject the ink toward the recording medium.

What is claimed is:

1. An image forming apparatus comprising:

a conveyance unit that conveys a recording medium;

a recording head comprising a nozzle formation surface formed with a plurality of nozzles for ejecting ink toward the recording medium being conveyed by the conveyance unit;

a cap that is able to abut against the nozzle formation surface of the recording head to form a closed space in which the nozzle formation surface is sealed off;

a cap holder that supports the cap with a predetermined gap between the cap holder and the base portion; and an elastic body disposed between the cap holder and the base portion, wherein the cap comprises:

the base portion facing the nozzle formation surface;

a lip portion that is upright from a base portion toward the nozzle formation surface to be able to abut against the nozzle formation surface;

an opening that passes through the base portion; and a gas impermeable flexible film that covers the opening, wherein the elastic body abuts the base portion between the lip portion and the flexible film.

2. The image forming apparatus according to claim 1, wherein the flexible film comprises a lamination of at least a first film having flexibility and a second film impermeable to gases.

3. The image forming apparatus according to claim 1, wherein the film is welded to the base portion.

4. The image forming apparatus according to claim 3, wherein the film has a convex shape protruding away from the nozzle formation surface in a section view taken along a direction in which the nozzles eject the ink toward the recording medium.

5. The image forming apparatus according to claim 3, wherein the film has a convex shape protruding toward the nozzle formation surface in a section view taken along a direction in which the nozzles eject the ink toward the recording medium.

6. An image forming apparatus comprising:

a conveyance unit that conveys a recording medium;

a recording head comprising a nozzle formation surface formed with a plurality of nozzles for ejecting ink toward the recording medium being conveyed by the conveyance unit; and a cap that is able to abut against the nozzle formation surface of the recording head to form a closed space in which the nozzle formation surface is sealed off, wherein the cap comprises:

base portion having a concave portion, which is concave to be distant from the nozzle formation surface, that faces the nozzle formation surface;

a lip portion that is upright from the base portion toward the nozzle formation surface to be able to abut against the nozzle formation surface;

an opening that passes through the base portion, the opening is formed in a bottom surface of the concave portion;

a protrusion that is formed in the bottom surface of the concave portion to protrude toward the nozzle formation surface and to surround the opening; and a flexible film that covers the opening, the film is welded to the protrusion to have a dome shape protruding toward the nozzle formation surface, wherein the film has a convex shape protruding toward the nozzle formation surface in a section view taken along a direction in which the nozzles eject the ink toward the recording medium.

7. The image forming apparatus according to claim 1, wherein: the base portion is made of a first resin material, and the lip portion is made of a second resin material, which has a larger elasticity than the first resin material.

8. The image forming apparatus according to claim 1, wherein the lip portion is formed in a mountain shape having one apex in a section view.

9. The image forming apparatus according to claim 1, wherein a maximum height of each lip portion is 0.75 to 2.5 times as large as a maximum width of the lip portion.

10. The image forming apparatus according to claim 9, wherein: the maximum height of each lip portion is in a range of from 1.0 mm to 2.0 mm, and the maximum width of each lip portion is in a range of from 1.5 mm to 2.5 mm.

11. The image forming apparatus according to claim 1, wherein each lip portion has a JIS A hardness in a range of 10 degrees to 20 degrees.

12. The image forming apparatus according to claim 1, wherein the recording head is of a line head type.

13. A cap used for an image forming apparatus comprising a conveyance unit that conveys a recording medium, and a recording head comprising a nozzle formation surface formed with a plurality of nozzles for ejecting ink toward the recording medium being conveyed by the conveyance unit, the cap being able to abut against the nozzle formation surface so as to form a closed space in which the nozzle formation surface is sealed off, the cap comprising:

a base portion that faces the nozzle formation surface;

a lip portion that is upright from the base portion toward the nozzle formation surface so as to be able to abut against the nozzle formation surface;

an opening that passes through the base portion; and a gas impermeable flexible film that covers the opening, wherein a cap holder supports the cap with a predetermined gap between the cap holder and the base portion, an elastic body is disposed between the cap holder and the base portion, and the elastic body abuts the base portion between the lip portion and the flexible film.

* * * * *